US009933205B2

(12) United States Patent
Hatomura et al.

(10) Patent No.: US 9,933,205 B2
(45) Date of Patent: Apr. 3, 2018

(54) AIR-CONDITIONING APPARATUS

(75) Inventors: Takeshi Hatomura, Tokyo (JP); Koji Yamashita, Tokyo (JP); Hiroyuki Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1199 days.

(21) Appl. No.: 14/111,795

(22) PCT Filed: May 23, 2011

(86) PCT No.: PCT/JP2011/002863

§ 371 (c)(1),
(2), (4) Date: Oct. 15, 2013

(87) PCT Pub. No.: WO2012/160598

PCT Pub. Date: Nov. 29, 2012

(65) Prior Publication Data

US 2014/0033754 A1 Feb. 6, 2014

(51) Int. Cl.
*F25B 13/00* (2006.01)
*F25D 29/00* (2006.01)
(Continued)

(52) U.S. Cl.
CPC ..... *F25D 29/006* (2013.01); *F24F 3/065* (2013.01); *F25B 9/006* (2013.01); *F25B 13/00* (2013.01);
(Continued)

(58) Field of Classification Search
CPC .. F24F 11/04; F24F 11/008; F24F 3/06; F24F 2011/0084; F24D 19/1015; F24D 19/1084;
(Continued)

(56) References Cited

U.S. PATENT DOCUMENTS 5,415,006 A * 5/1995 Renken ..... B60H 1/00014 62/196.4
7,493,775 B2 * 2/2009 Shimamoto ..... F24F 3/065 62/199
(Continued)

FOREIGN PATENT DOCUMENTS

JP 62-77769 U 5/1987
JP 6277769 U 5/1987
(Continued)

OTHER PUBLICATIONS

International Search Report of the International Searching Authority dated Aug. 12, 2011 or the corresponding international application No. PCT/JP2011/002863 (and English translation).
(Continued)

*Primary Examiner* — Jianying Atkisson
*Assistant Examiner* — Meraj A Shaikh
(74) *Attorney, Agent, or Firm* — Posz Law Group, PLC

(57) ABSTRACT

An outdoor unit is configured to include a compressor and a heat source side heat exchanger. Indoor units are configured to include first expansion devices and use side heat exchangers, and air-condition an air-conditioned space. Branching devices, connected by pipes to the outdoor unit by a plurality of main pipes and connected by pipes to each indoor unit by a plurality of branch pipes, are configured to branch a refrigerant from a side of the main pipes and circulate the refrigerant to the branch pipes, and converge the refrigerant from a side of the branch pipes and circulate the refrigerant to the main pipes. A refrigerant concentration detecting device is installed in a non-air-conditioned space. A shutoff valve control device is configured, upon determining that the refrigerant has leaked, to control shutoff devices and to shut off the refrigerant flows.

20 Claims, 13 Drawing Sheets

(51) Int. Cl.

| | |
|---|---|
| ***F25B 9/00*** | (2006.01) |
| ***F25B 49/00*** | (2006.01) |
| ***F24F 3/06*** | (2006.01) |
| *F24F 11/00* | (2018.01) |

(52) U.S. Cl.
CPC ..... *F25B 49/005* (2013.01); *F24F 2011/0052* (2013.01); *F24F 2011/0084* (2013.01); *F25B 2313/006* (2013.01); *F25B 2313/0231* (2013.01); *F25B 2313/0233* (2013.01); *F25B 2313/02741* (2013.01); *F25B 2500/22* (2013.01)

(58) Field of Classification Search
CPC ..... F25B 2500/222; F25B 2400/12; F25B 13/00; F25B 49/005; F25B 25/005
USPC ..... 62/126, 186, 333
See application file for complete search history.

(56) References Cited

U.S. PATENT DOCUMENTS

| | | | | |
|---|---|---|---|---|
| 8,844,301 | B2 * | 9/2014 | Yamashita | F24F 3/06 62/126 |
| 9,353,979 | B2 * | 5/2016 | Morimoto | F24F 3/06 |
| 9,377,211 | B2 * | 6/2016 | Yamashita | F24F 1/06 |
| 9,631,831 | B2 * | 4/2017 | Thuillard | F24F 11/008 |
| 9,638,430 | B2 * | 5/2017 | Motomura | F25B 13/00 |
| 2007/0157650 | A1 * | 7/2007 | Takegami | F25B 13/00 62/230 |
| 2009/0145151 | A1 * | 6/2009 | Wakamoto | F25B 9/008 62/259.1 |
| 2011/0160918 | A1 * | 6/2011 | McMasters | F25B 45/00 700/282 |
| 2013/0192283 | A1 * | 8/2013 | Yamashita | F24F 1/32 62/126 |

FOREIGN PATENT DOCUMENTS

| | | | |
|---|---|---|---|
| JP | 10-115478 | A | 5/1998 |
| JP | 2002-115939 | A | 4/2002 |
| JP | 2002-372317 | A | 12/2002 |
| JP | 2003-130482 | A | 5/2003 |
| JP | 2004-116885 | A | 4/2004 |
| JP | 2005-241052 | A | 9/2005 |
| JP | 2009-299910 | A | 12/2009 |
| JP | 2000-274894 | A | 10/2010 |
| WO | 2010-050007 | A1 | 5/2010 |

OTHER PUBLICATIONS

Office Action dated Sep. 30, 2014 issued in corresponding JP patent application No. 2013-516073 (and English translation).
Office Action dated May 12, 2015 in the corresponding JP application No. 2013-516073 (English translation attached).
Office Action dated Sep. 5, 2017 issued in corresponding GB patent application No. 1319177.0.

* cited by examiner

AIR-CONDITIONING APPARATUS

CROSS REFERENCE TO RELATED APPLICATION

This application is a U.S. national stage application of PCT/JP2011/002863 filed on May 23, 2011.

TECHNICAL FIELD

The present invention relates to an air-conditioning apparatus applied to a multi-air-conditioning system for a building, for example.

BACKGROUND

Heretofore, in an air-conditioning apparatus such as a multi-air-conditioning system for a building, a refrigerant circuit is constituted and a refrigerant is circulated by connecting pipes between an outdoor device (outdoor unit), which is a heat source device installed on the outside of the building, and indoor devices (indoor units) installed inside the building, for example. An air-conditioned space is then heated or cooled by utilizing heat rejection and heat removal of the refrigerant to heat or cool air.

In such a multi-air-conditioning system for a building, a plurality of indoor units is connected by pipes, and there is often a mixture of stopped indoor units and running indoor units. The pipes that connect the outdoor unit to the indoor units may also reach 100 m, for example. As the pipes become longer, more the refrigerant fills the air-conditioning apparatus.

The indoor units of such a multi-air-conditioning system for a building are typically disposed and used in indoor spaces where people are present (such as office spaces, rooms, and stores, for example). At this point, if for some reason refrigerant leaks out of an indoor unit disposed in an indoor space, the refrigerant may be flammable or toxic depending on the refrigerant type, thus posing a serious problem from the perspective of the effects on and the safety of the human body, for example. In addition, even assuming that the refrigerant is not harmful to the human body, for example, the refrigerant leakage is expected to lower the oxygen concentration in the indoor space and exert an adverse influence on the human body.

Consequently, there has been proposed a system that suppresses the quantity of refrigerant leaking indoors by providing the outdoor unit with a refrigerant leakage sensor and a pipe shutoff valve, such that refrigerant does not flow out of the outdoor unit if a refrigerant leak occurs (see Patent Literature 1, for example).

PATENT LITERATURE

Patent Literature 1: Japanese Unexamined Patent Application Publication No. 2002-115939 (e.g., P. 7 etc.)

Meanwhile, global warming concerns recently have led to action to restrict the use of HFC refrigerants with high global warming potential (such as R410A, R404A, R407C, and R134a, for example). For this reason, air-conditioning apparatus using refrigerants with low global warming potential (such as HFO-1234yf, R32, HC (hydrocarbon), and carbon dioxide, for example) are being proposed. In addition, flammable refrigerants (such as HFO-1234yf, HFO-1234ze, R32, mixed refrigerants containing R32 and HFO-1234yf, mixed refrigerants containing at least one of the above refrigerants as a component, and HC, for example) are used as the refrigerant in a multi-air-conditioning system for a building. Even with such refrigerants, large quantities of refrigerant are still required when utilized in a multi-air-conditioning system for a building. For this reason, it is necessary to adopt countermeasures in the event of a leak of these refrigerants in an indoor space.

For example, the technology described in Patent Literature 1 relates to an air-conditioning apparatus that suppresses the quantity of flammable refrigerant leaking indoors by providing the outdoor unit with a refrigerant leakage sensor and a pipe shutoff valve. However, with air-conditioning apparatus in which many indoor units are connected and the pipe lengths inside a building are long, such as with a multi-air-conditioning system for a building, the refrigerant leakage quantity in areas such as the indoor units and the pipes connected to those indoor units must also be taken into account. For example, in order to ensure the safety of the apparatus when a flammable refrigerant having flammable properties leaks, it is necessary to provide some kind of safety apparatus with respect to the equipment, pipes, and the like installed inside the building.

SUMMARY

The present invention, being devised in order to solve the above problem, provides an air-conditioning apparatus able to reduce the load exerted on the environment while ensuring safety.

An air-conditioning apparatus according to the present invention includes an outdoor unit configured to include a compressor and a heat source side heat exchanger, a plurality of indoor units configured to include load-side expansion devices and load-side heat exchangers, and air-condition an air-conditioned space, branching devices, connected by pipes to the outdoor unit by a plurality of main pipes and connected by pipes to each indoor unit by a plurality of branch pipes, configured to branch a refrigerant from a side of the main pipes and circulate the refrigerant to the branch pipes, and converge the refrigerant from a side of the branch pipes and circulate the refrigerant to the main pipes, a refrigerant concentration detecting device installed in a non-air-conditioned space, which is a different space from the air-conditioned space, and which is in a relative position where the refrigerant may potentially spread into the air-conditioned space if the refrigerant leaks, main pipe side shutoff devices on the side of the main pipes configured to shut off flows between the outdoor unit and the branching devices on the side of the main pipes and/or shutoff devices on a side of the branch pipes configured to shut off flows between the indoor units and the branching devices on the side of the branch pipes, and a controller configured, upon determining that the refrigerant has leaked on a basis of a detection by the refrigerant concentration detecting device, to control the shutoff devices to shut off the flows of refrigerant, wherein the branching devices are installed in the non-air-conditioned space, and provided that a refrigerant quantity inside the main pipes is a main-pipe enclosed refrigerant quantity W1 (kg), a refrigerant quantity inside the branch pipes is a branch-pipe enclosed refrigerant quantity W2 (kg), a refrigerant quantity inside the outdoor unit is M1 (kg), and a refrigerant quantity inside the indoor units is M2 (kg), and one of either a value (W1+M1)/V obtained by dividing a sum of the main-pipe enclosed refrigerant quantity W1 and the refrigerant quantity M1 inside the outdoor unit by a volume V (m3) of the air-conditioned space, or a value (W2+M2)/V obtained by dividing a sum of the branch-pipe enclosed refrigerant quantity W2 and the refrigerant quantity M2 inside the indoor units by the volume V (m3) of the air-conditioned space, is equal to or greater than a refrigerant charged quantity limit value B (kg/m3) determined on a basis of a flammability risk of the refrigerant, the shut off devices shut off pipes on a side equal to or greater than the refrigerant charged quantity limit value B (kg/m3).

According to an air-conditioning apparatus according to the present invention, for a refrigerant leak from a refrigerant circuit, if the control device determines that the refrigerant has leaked on the basis of a refrigerant concentration detected by the refrigerant concentration detecting device in a non-air-conditioned space such as above the ceiling, the control devices causes the shutoff devices to shut off the flow of refrigerant, thereby minimizing refrigerant leakage in the non-air-conditioned space, preventing the spread of refrigerant to the air-conditioned space, and not only greatly improving safety, but also reducing the environmental load.

DESCRIPTION OF EMBODIMENTS

Figure 1:
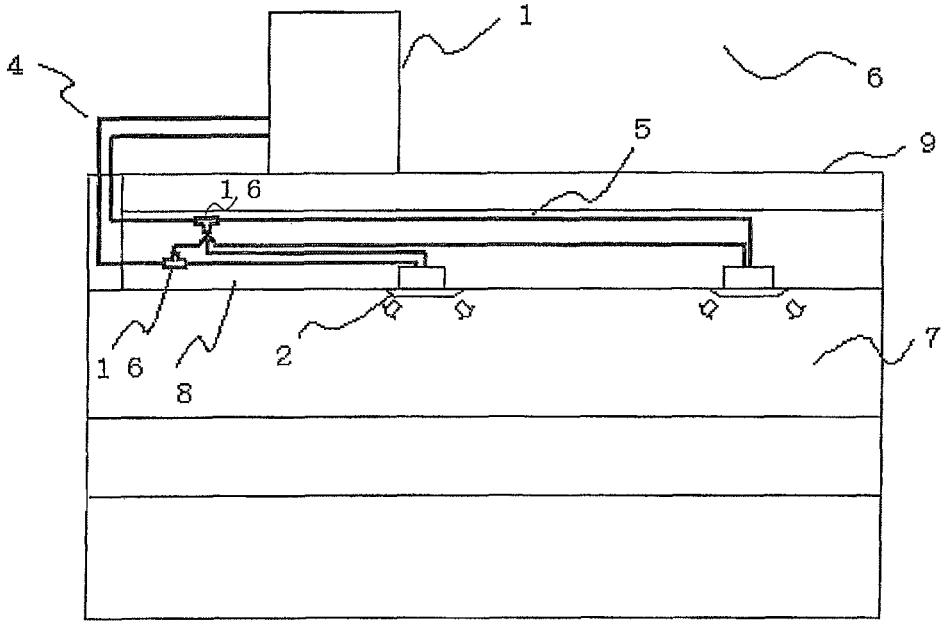
FIG. 1 is a schematic diagram illustrating an exemplary installation of an air-conditioning apparatus according to Embodiment 1 of the present invention.

Hereinafter, embodiments of the present invention will be described with reference to the drawings. Herein, in the drawings hereinafter, including FIG. 1, the relative sizes of respective structural members may differ from actual sizes in some cases. Also, a plurality of devices of the same type differentiated by subscripts or the like may be described in some cases by omitting the subscripts when individual devices need not be differentiated or specified. Also, in terms of high/low of the temperatures and pressures described hereinafter are not defined by absolute values or the like in particular, the description thereof are expressed on the basis of relationships determined relatively in accordance with factors such as the state and operation in the apparatus or the like.

Embodiment 1

FIG. 1 is a diagram illustrating an exemplary installation of an air-conditioning apparatus according to Embodiment 1 of the present invention. An exemplary installation of an air-conditioning apparatus according to Embodiment 1 will be described with reference to FIG. 1. The air-conditioning apparatus is an apparatus that circulates a refrigerant and performs air conditioning utilizing a refrigeration cycle. In addition, the air-conditioning apparatus can select a cooling only operation mode in which all running indoor units perform cooling, or a heating only operation mode in which all running indoor units perform heating.

As illustrated in FIG. 1, the air-conditioning apparatus according to Embodiment 1 includes one outdoor unit 1 which is a heat source device, and a plurality of indoor units 2. The outdoor unit 1 and the indoor units 2 are connected by main pipes 4 that conduct the refrigerant, and branch pipes 5 that conduct the refrigerant via branching devices 16 that branch the refrigerant. Herein, the branching devices 16 are also used as devices that converge the flows of refrigerant in some cases. Also, cooling energy or heating energy generated at the outdoor unit 1 is delivered to the indoor units 2. Although described in detail in FIG. 2, the air-conditioning apparatus of Embodiment 1 includes a first shutoff device 42 and a second shutoff device 43 serving as main pipe shutoff devices on the main pipe 4 side of the branching devices 16, and includes third shutoff devices 37 and fourth shutoff devices 38 serving as branch pipe shutoff devices on the branch pipe 5 side of the branching devices 16.

The outdoor unit 1 is typically placed in an outdoor space 6, which is a space outside a structure or building 9 (such as the roof, for example), and provides cooling energy or heating energy to the indoor units 2 via the main pipes 4, the branching devices 16, and the branch pipes 5. The indoor units 2 are disposed at positions able to supply cooled air or heated air to an indoor space 7, which is a space inside the building 9 (such as a room, for example), and supply cooled air or heated air to the indoor space 7 to be air-conditioned (including air ducts or the like running indoors).

As illustrated in FIG. 1, in an air-conditioning apparatus according to the present invention, the outdoor unit 1 and the indoor units 2 are connected using two main pipes 4, while the branching devices 16 and each of the indoor units 2 are connected by two branch pipes 5.

FIG. 1 illustrates, as an example, a state in which the branching devices 16 are collectively installed in a space which, although inside the building 9, is separate from the indoor space 7, such as above the ceiling (for example, a space such as above the ceiling in the building 9, hereinafter simply referred to as the non-air-conditioned space 8). Collectively installing the branching devices 16 makes it possible to reduce the refrigerant leakage detection range and this improves safety. Otherwise, the branching devices 16 are installable in a shared space containing an elevator or the like. Additionally, although FIG. 1 illustrates the case where the indoor units 2 are ceiling cassettes as an example, the configuration is not limited thereto. The indoor units 2 may be of any type, such as ceiling-concealed or ceiling-suspended units, insofar as the indoor units 2 are able to expel heated air or cooled air into the indoor space 7 directly or via means such as ducts.

Also, although FIG. 1 illustrates the case of the outdoor unit 1 being installed in the outdoor space 6 as an example, the configuration is not limited thereto. For example, the outdoor unit 1 may also be installed in an enclosed space such as a ventilated machine room. The outdoor unit 1 may also be installed inside the building 9 insofar as waste heat can be exhausted outside the building 9 by an exhaust duct. Alternatively, the outdoor unit 1 may also be installed inside the building 9 in the case of using a water-cooled outdoor unit 1. Installing the outdoor unit 1 in such locations is not particularly problematic.

Figure 2:
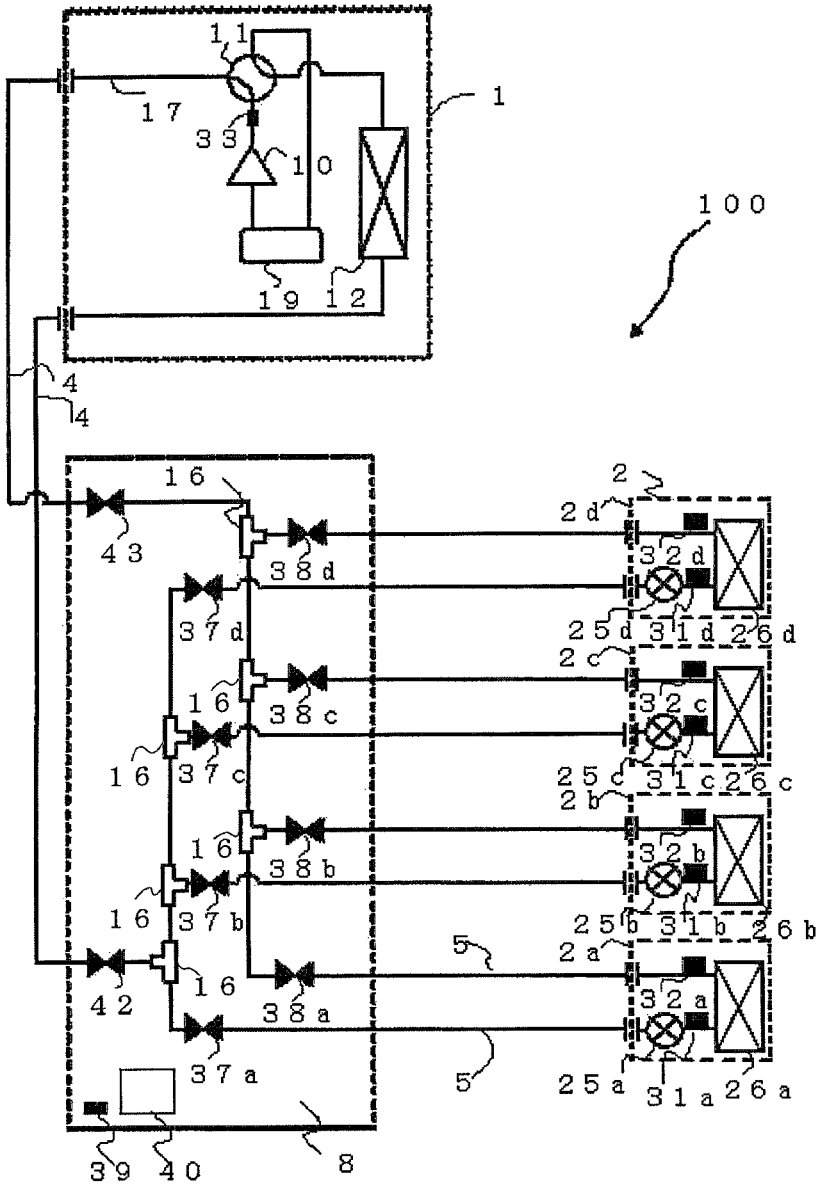
FIG. 2 is a diagram illustrating an exemplary configuration of an air-conditioning apparatus 100 according to Embodiment 1 of the present invention.

FIG. 2 is a diagram illustrating an exemplary configuration of an air-conditioning apparatus 100 according to Embodiment 1 of the present invention. A detailed configuration of the air-conditioning apparatus 100 will be described with reference to FIG. 2. As illustrated in FIG. 2, in Embodiment 1, an outdoor unit 1 and a plurality of indoor units 2 are connected by main pipes 4 and branch pipes 5. In addition, a first shutoff device 42 and a second shutoff device 43 are provided between the main pipes 4 and branching devices 16. Also, third shutoff devices 37 (37*a* to 37*d*) and fourth shutoff devices 38 (38*a* to 38*d*) are provided between the branching devices 16 and the branch pipes 5.

(Outdoor Unit 1)

The outdoor unit 1 includes a compressor 10, a refrigerant flow switching device 11 such as a four-way valve, a heat source side heat exchanger 12, and an accumulator 19, which are connected in series by refrigerant pipes 17.

The compressor 10 suctions the refrigerant and compresses the refrigerant to a high temperature, high pressure state. The compressor 10 may be configured as a variable-capacity inverter compressor, for example. The refrigerant flow switching device 11 switches between a flow of refrigerant in a heating only operation mode, and a flow of refrigerant in a cooling only operation mode.

The heat source side heat exchanger 12 functions as an evaporator during a heating operation, functions as a condenser during a cooling operation, and exchanges heat between the refrigerant and air supplied from an air-sending device such as a fan (not illustrated). The accumulator 19 is provided at the intake of the compressor 10 and accumulates an excess refrigerant produced due to the difference between the heating only operation mode and the cooling only operation mode and an excess refrigerant produced due to transitional changes in operation (for example, a change in the number of operating indoor units 2).

The outdoor unit 1 is also provided with a pressure sensor 35 as pressure detecting means, which detects the pressure of the high temperature and high pressure refrigerant compressed and discharged by the compressor 10.

(Indoor Units 2)

The indoor units 2 respectively include a use side heat exchanger 26 and an expansion device 25. The use side heat exchangers 26 connect to the outdoor unit 1 via the main pipes 4, the branching devices 16, and the branch pipes 5, such that the refrigerant flows in and flows out. The use side heat exchangers 26 exchange heat between the refrigerant and air supplied from an air-sending device such as a fan (not illustrated), and generate heated air or cooled air to supply to the indoor space 7, for example. Also, the expansion devices 25 function as pressure reducing valves or expansion valves that depressurize the refrigerant to expand. The expansion devices 25 are provided on the upstream side of the use side heat exchangers 26 in the flow of refrigerant during the cooling only operation mode. The expansion devices 25 may be configured to have variably controllable opening degrees, such as electronic expansion valves, for example.

Additionally, the indoor units 2 are provided with first temperature sensors 31 and second temperature sensors 32 as temperature detecting means, which detect the temperature of refrigerant flowing into the use side heat exchangers 26, or detect the temperature of refrigerant flowing out of the use side heat exchangers. The first temperature sensors 31 are provided on the pipes between the expansion device 25 and the use side heat exchangers 26, while the second temperature sensors 32 are provided on the pipes above the use side heat exchangers 26 on the page, and may be configured as thermistors or the like.

FIG. 2 illustrates a case where four indoor units 2 are connected to the outdoor unit 1 via the main pipes 4, the branching devices 16, and the branch pipes 5 as an example, and these indoor units 2 are indicated as an indoor unit 2*a*, an indoor unit 2*b*, an indoor unit 2*c*, and an indoor unit 2*d* from the bottom of the page. Also, in correspondence with the indoor units 2*a* to 2*d*, the use side heat exchangers 26 are likewise indicated as a use side heat exchanger 26*a*, a use side heat exchanger 26*b*, a use side heat exchanger 26*c*, and a use side heat exchanger 26*d* from the bottom of the page. The expansion devices 25 are also likewise indicated as an expansion device 25*a*, an expansion device 25*b*, an expansion device 25*c*, and an expansion device 25*d* from the bottom of the page. The first temperature sensors 31 are also likewise indicated as a first temperature sensor 31*a*, a first temperature sensor 31*b*, a first temperature sensor 31*c*, and a first temperature sensor 31*d*. The second temperature sensors 32 are also likewise indicated as a second temperature sensor 32*a*, a second temperature sensor 32*b*, a second temperature sensor 32*c*, and a second temperature sensor 32*d*. Note that although four indoor units 2 are connected in FIG. 2, the number of connected units is not limited to four.

Figure 3:
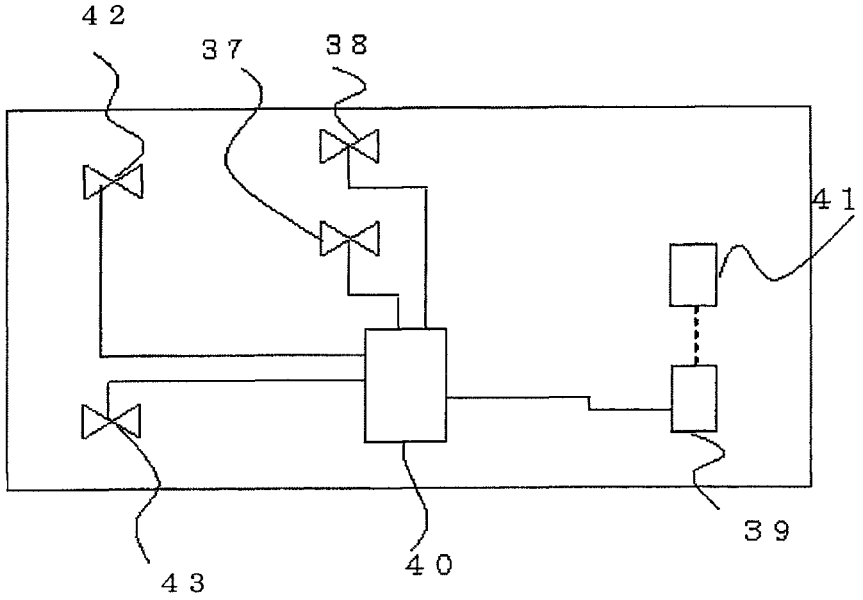
FIG. 3 is a diagram illustrating an example of structural relationships among shutoff devices 37, 38, 42, and 43, a concentration detecting device 39, and a shutoff valve control device 40.

FIG. 3 is a diagram illustrating an example of structural relationships among shutoff devices 37, 38, 42, and 43, a concentration detecting device 39, and a shutoff valve control device 40. As illustrated in FIGS. 2 and 3, the concentration detecting device 39 is provided in the non-air-conditioned space 8, and detects the concentration of refrigerant inside the non-air-conditioned space 8 as an electrical resistance value, for example. In FIG. 2, the concentration detecting device 39 is installed in the vicinity of the branching device 16 in the non-air-conditioned space 8 that communicates with the indoor unit 2*a*, but the installation position is not limited thereto, and may also be installed in the vicinity of any branching device 16, for example.

The first shutoff device 42 is installed on the main pipe 4 through which the refrigerant in a liquid state (liquid refrigerant) flows, while the second shutoff device 43 is installed on the main pipe 4 through which the refrigerant in a gaseous state (gas refrigerant) flows. The third shutoff devices 37 are installed on the branch pipes 5 on the liquid refrigerant side, while the fourth shutoff devices 38 are installed on the branch pipes 5 on the gas refrigerant side. Each shutoff device includes a shutoff valve, and on the basis of instructions (a signal) from the shutoff valve control device 40, closes the refrigerant flow with the shutoff valve to shut off the flow of refrigerant. In the shutoff devices, a non-conducting state is a closed state.

Also, FIG. 2 illustrates a case where four indoor units 2 are connected to the outdoor unit 1 via the main pipes 4, the branching devices 16, and the branch pipes 5 as an example, in which the third shutoff devices 37 are indicated as a third shutoff device 37*a*, a third shutoff device 37*b*, a third shutoff device 37*c*, and a third shutoff device 37*d* from the bottom of the page, and in which the fourth shutoff devices 38 are indicated as a fourth shutoff device 38*a*, a fourth shutoff device 38*b*, a fourth shutoff device 38*c*, and a fourth shutoff device 38*d* from the bottom of the page. Detailed description of detecting means, opening and closing means, and installation positions will be discussed later. Note that the third shutoff devices 37 and the fourth shutoff devices 38 are installed in a configuration that depends on the number of connected indoor units 2 as illustrated in FIG. 2, and that the number of each is not limited to four.

Additionally, a concentration computing device 41 is a device for computing concentration on the basis of data related to concentration obtained from the detection by the concentration detecting device 39 (an electrical resistance value). Although specific processing by the device will be discussed later, computation is performed by storing data corresponding to the calibration curves expressed in FIG. 6 discussed later, for example. By performing computation by the concentration computing device 41 to compute concentration, it is possible to issue opening and closing instructions to each shutoff device individually, such as closing the shutoff devices corresponding to the pipes through which the refrigerant flows into the branching devices 16, for example.

Also, although omitted from the drawings, a control device made up of a microcomputer or the like is included, and on the basis of detected information from various detecting means and instructions from a remote control, controls parameters such as the driving frequency of the compressor 10, the rotation rate of air-sending devices (including on/off), the switching of the refrigerant flow switching device 11, and the opening degree of the expansion devices 25, and performs the respective operation modes discussed later. For example, the control device may be configured to compute concentration as the concentration computing device 41 discussed above, or to control the opening and closing of the first shutoff device 42, the second shutoff device 43, the third shutoff devices 37, and the fourth shutoff devices 38 as the shutoff valve control device 40. Note that a control device may be provided for each unit, or may be provided for the outdoor unit 1 or the indoor units 2.

Next, the respective operation modes performed by the air-conditioning apparatus 100 will be described. The air-conditioning apparatus 100 is capable of cooling operation only or heating operation only, on the basis of instructions from each of the indoor units 2. For this reason, the air-conditioning apparatus 100 is configured such that all indoor units 2 being driven to perform the same operation.

The operation modes performed by the air-conditioning apparatus 100 include a cooling only operation mode in which all indoor units 2 perform the cooling operation, and a heating only operation mode in which all indoor units 2 perform the heating operation. Hereinafter, the respective operation modes will be described together with the flow of refrigerant.

(Cooling Only Operation Mode)

Figure 4:
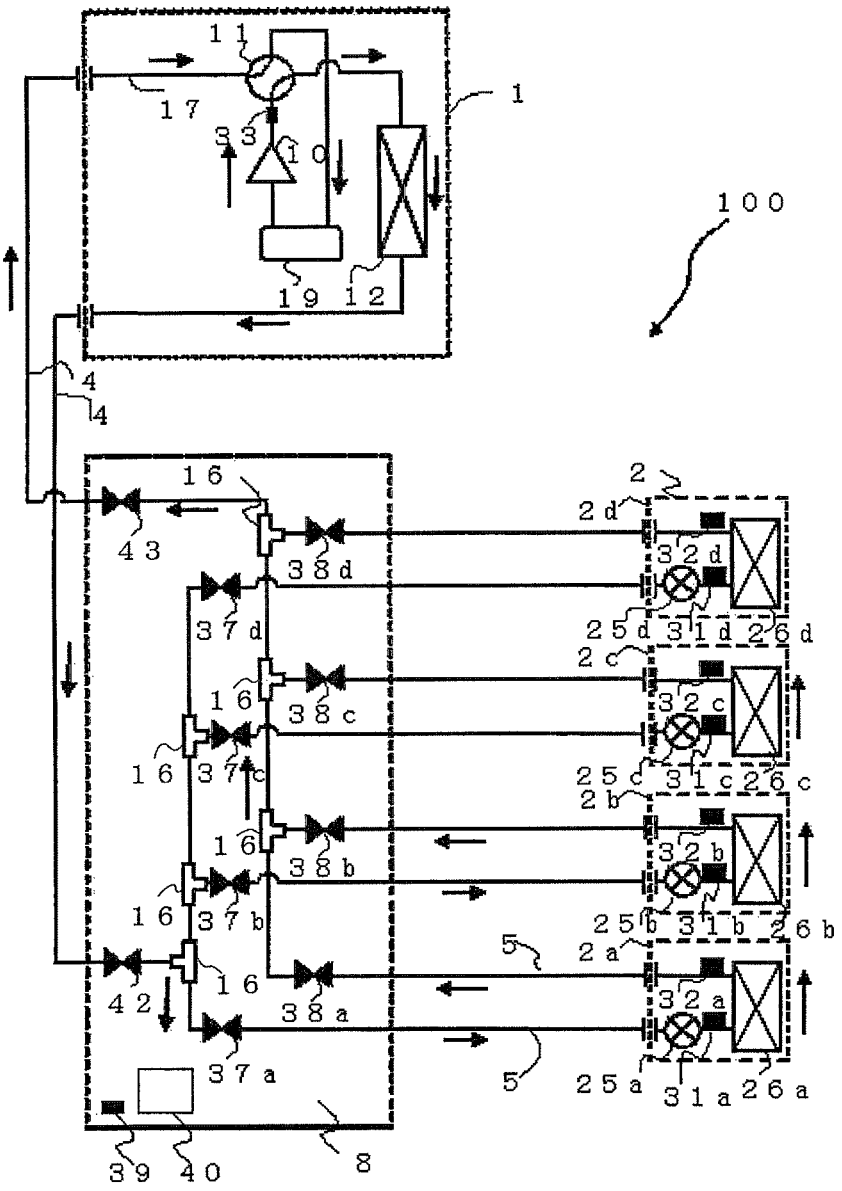
FIG. 4 is a refrigerant circuit diagram illustrating the flow of refrigerant during a cooling only operation mode of the air-conditioning apparatus according to Embodiment 1 of the present invention.

FIG. 4 is a refrigerant circuit diagram illustrating the flow of refrigerant during a cooling only operation mode of the air-conditioning apparatus 100. The cooling only operation mode will be described with reference to FIG. 4, taking as an example the case where a cooling load is generated by the use side heat exchanger 26*a* and the use side heat exchanger 26*b*. Note that in FIG. 4, solid arrows indicate the direction of refrigerant flow.

In the case of the cooling only operation mode illustrated in FIG. 4, the low temperature and low pressure refrigerant is compressed by the compressor 10 to become the high temperature and high pressure gas refrigerant, and is discharged. The high temperature and high pressure gas refrigerant discharged from the compressor 10 flows into the heat source side heat exchanger 12 via the refrigerant flow switching device 11. The refrigerant becomes the high pressure liquid refrigerant while transferring heat to the outside air in the heat source side heat exchanger 12. The high pressure refrigerant flowing out of the heat source side heat exchanger 12 flows out of the outdoor unit 1, through a main pipe 4, and is branched via the first shutoff device 42 and the branching devices 16. Then, after passing through the third shutoff device 37*a*, the third shutoff device 37*b*, and the branch pipes 5, the refrigerant is expanded by the expansion device 25*a* and the expansion device 25*b* to become the low temperature and low pressure two-phase refrigerant. The two-phase refrigerant respectively flows into the use side heat exchanger 26*a* and the use side heat exchanger 26*b* serving as evaporators, and becomes the low temperature and low pressure gas refrigerant while cooling indoor air by taking away heat from the indoor air. The gas refrigerant flowing out of the use side heat exchanger 26*a* and the use side heat exchanger 26*b* passes through the branch pipes 5, the fourth shutoff device 38*a*, the fourth shutoff device 38*b*, the branching devices 16, the second shutoff device 43, and a main pipe 4, and once again flows into the outdoor unit 1. The refrigerant flowing into the outdoor unit 1 passes through the refrigerant flow switching device 11 and the accumulator 19, and is once again suctioned into the compressor 10.

At this point, the opening degree of the expansion device 25*a* is controlled such that the superheat (degree of superheat) obtained as the difference between the temperature detected by the first temperature sensor 31*a* and the temperature detected by the second temperature sensor 32*a* becomes constant. Similarly, the opening degree of the expansion device 25*b* is controlled such that the superheat (degree of superheat) obtained as the difference between the temperature detected by the first temperature sensor 31*b* and the temperature detected by the second temperature sensor 32*a* becomes constant.

Meanwhile, for the use side heat exchanger 26*c* and the use side heat exchanger 26*d* without a cooling load, there is no need to circulate the refrigerant, and the respectively corresponding expansion device 25*c* and expansion device 25*d* are closed. Furthermore, in the case where a cooling load is generated from the use side heat exchanger 26*c* or the use side heat exchanger 26*d*, the expansion device 25*c* or the expansion device 25*d* may be opened to allow the circulation of refrigerant. The opening degree of the expansion device 25*c* or the expansion device 25*d* is controlled such that the superheat (degree of superheat) obtained as the difference between the temperature detected by the first temperature sensor 31*c* or 31*d* and the temperature detected by the second temperature sensor 32*c* or 32*d* becomes constant, similarly to the expansion device 25*a* and the expansion device 25*b* discussed above.

(Heating Only Operation Mode)

Figure 5:
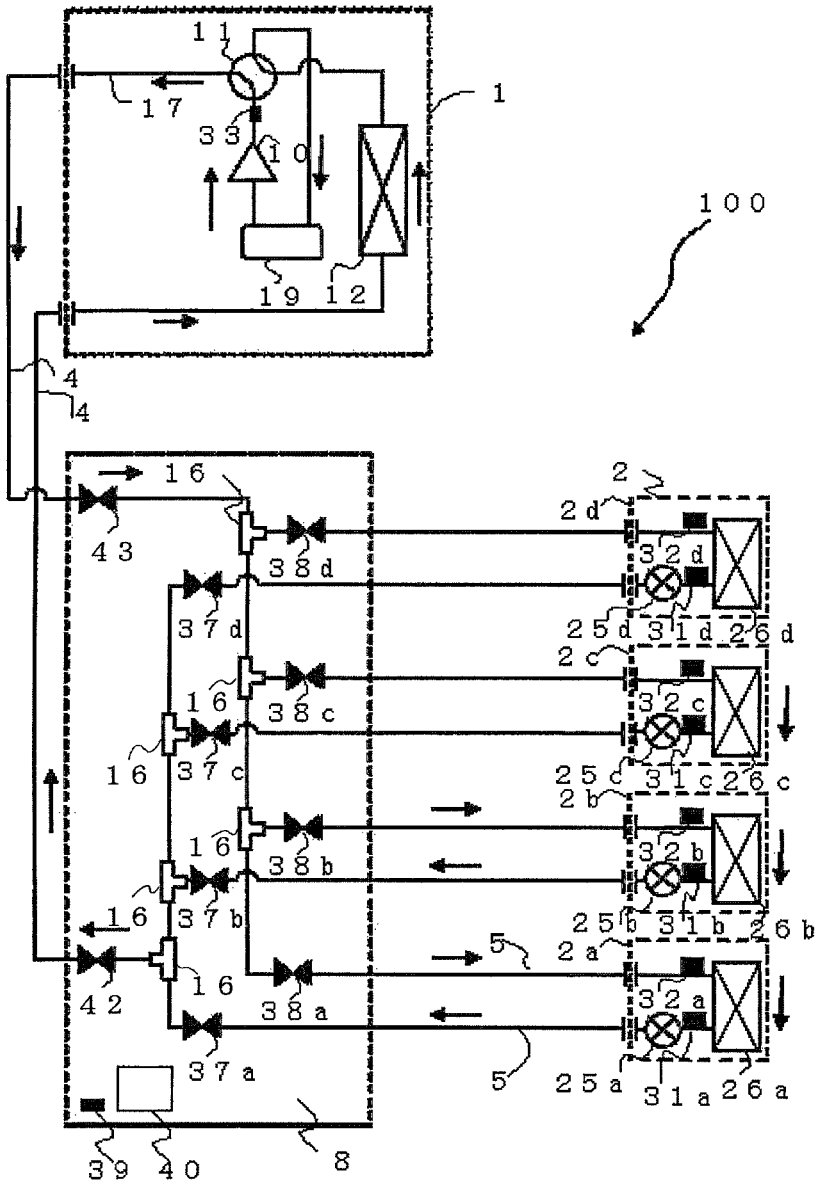
FIG. 5 is a refrigerant circuit diagram illustrating the flow of refrigerant during a heating only operation mode of the air-conditioning apparatus according to Embodiment 1 of the present invention.

FIG. 5 is a refrigerant circuit diagram illustrating the flow of refrigerant during a heating only operation mode of the air-conditioning apparatus 100. The heating only operation mode will be described with reference to FIG. 5, taking as an example the case where a heating load is generated by the use side heat exchanger 26*a* and the use side heat exchanger 26*b* only. Note that in FIG. 5, solid arrows indicate the direction of refrigerant flow.

In the case of the heating only operation mode illustrated in FIG. 5, the low temperature and low pressure refrigerant is compressed by the compressor 10 to become the high temperature and high pressure gas refrigerant, and is discharged. The high temperature and high pressure gas refrigerant discharged from the compressor 10 passes through the refrigerant flow switching device 11, and flows out of the outdoor unit 1. The high temperature and high pressure gas refrigerant flowing out of the outdoor unit 1 passes through a main pipe 4 and is branched via the second shutoff device 43 and the branching devices 16. Then, after passing through the fourth shutoff device 38*a*, the fourth shutoff device 38*b*, and the branch pipes 5, the refrigerant becomes the liquid refrigerant while heating the indoor space 7 by transferring heat to the indoor air at the use side heat exchanger 26*a* and the use side heat exchanger 26*b*. The liquid refrigerant flowing out of the use side heat exchanger 26*a* and the use side heat exchanger 26*b* is expanded by the expansion device 25*a* and the expansion device 25*b* to become the low temperature and low pressure two-phase refrigerant, passes through the branch pipes 5, the third shutoff device 37*a*, the third shutoff device 37*b*, the branching devices 16, the first shutoff device 42, and a main pipe 4, and once again flows into the outdoor unit 1. The low temperature and low pressure two-phase refrigerant flowing into the outdoor unit 1 becomes the low temperature and low pressure gas refrigerant while taking away heat from outside air at the heat source side heat exchanger 12, and is once again suctioned into the compressor 10 via the refrigerant flow switching device 11 and the accumulator 19.

At this point, the opening degree of the expansion device 25*a* is controlled such that the subcooling (degree of subcooling) obtained as the difference between the temperature detected by the first temperature sensor 31*a* and a value obtained by converting the pressure detected by the pressure sensor 35 into a saturation temperature becomes constant. Similarly, the opening degree of the expansion device 25*b* is controlled such that the subcooling (degree of subcooling) obtained as the difference between the temperature detected by the first temperature sensor 31*b* and a value obtained by converting the pressure detected by the pressure sensor 35 into a saturation temperature becomes constant.

Meanwhile, for the use side heat exchanger 26*c* and the use side heat exchanger 26*d* without a heating load, there is no need to circulate the refrigerant, and the respectively corresponding expansion device 25*c* and expansion device 25*d* are closed. Furthermore, in the case where a heating load is generated from the use side heat exchanger 26*c* or the use side heat exchanger 26*d*, the expansion device 25*c* or the expansion device 25*d* may be opened to allow the circulation of refrigerant. The opening degree of the expansion device 25*c* or the expansion device 25*d* is controlled such that the subcooling (degree of subcooling) obtained as the difference between the temperature detected by the first temperature sensor 31*c* or 31*d* and a value obtained by converting the pressure detected by the pressure sensor 35 into a saturation temperature becomes constant, similarly to the expansion device 25*a* and the expansion device 25*b* discussed above.

Meanwhile, the concentration detecting device 39 is connected via the shutoff valve control device 40, as illustrated in FIGS. 2 and 3. The shutoff valve control device 40 is structured such that a switch turns on or off according to a signal from the concentration detecting device 39. The concentration detecting device 39 outputs a voltage of DC 5 V as the signal when the detected concentration is a predetermined concentration or greater, and does not output a voltage when less than the predetermined concentration, for example. Although a voltage is used as the signal herein, a current or other output may also be used as the signal. In addition, the output voltage is not particularly set to 5 V, and may also be a voltage such as 12 V or 24 V. The predetermined concentration is set to a leak limit concentration of refrigerant used in the refrigerant circuit. For example, in the case of using a flammable refrigerant (such as HFO-1234yf, R32, or HC), the predetermined concentration is set to approximately 1/10 of the lower explosive limit. Also, in the case of using carbon dioxide as the refrigerant, the predetermined concentration is set to approximately 1/10 of a leak limit concentration.

When the concentration detecting device 39 detects the predetermined concentration and outputs a voltage of 5 V as the signal, the switch in the shutoff valve control device 40 switches to an off state. As discussed earlier, the shutoff valves in the first shutoff device 42, the second shutoff device 43, the third shutoff devices 37, and the fourth shutoff devices 38 are closed while in a non-conducting state, and opened while in a conducting state. Consequently, if the switch in the shutoff valve control device 40 switches off, power supply to the first shutoff device 42, the second shutoff device 43, the third shutoff devices 37, and the fourth shutoff devices 38 stops, and thus the shutoff valve in each shutoff device closes.

Herein, the coils for opening and closing the valve bodies of the first shutoff device 42, the second shutoff device 43, the third shutoff devices 37, and the fourth shutoff devices 38 are configured to be excited by a direct current voltage. For example, the shutoff devices used in Embodiment 1 are configured to operate at 12 V. The voltage is not particularly set to just 12 V for the operating voltage, and a voltage such as 24 V is also acceptable. Also, since the life of the coil is longer when using a direct current over the case of using an alternating current, a direct current coil is used in Embodiment 1. For this reason, the shutoff valve control device 40 includes a converter able to convert electric utility power (alternating current, AC 200 V in Embodiment 1) into a predetermined direct current voltage (DC 12 V in Embodiment 1).

In the case of using a flammable refrigerant (such as HFO-1234yf, R32, or HC), if the shutoff valve control device 40 has an electromagnet relay, mechanical or electrical content may produce sparks, thus risking ignition of flammable gas. Thus, using a solid-state relay (SRR) using semiconductor elements eliminates mechanical and electrical on/off switching, thereby eliminating the possibility of producing sparks and making it possible to safely switch the power on and off even if a flammable refrigerant leaks into the non-air-conditioned space 8.

Figure 6:
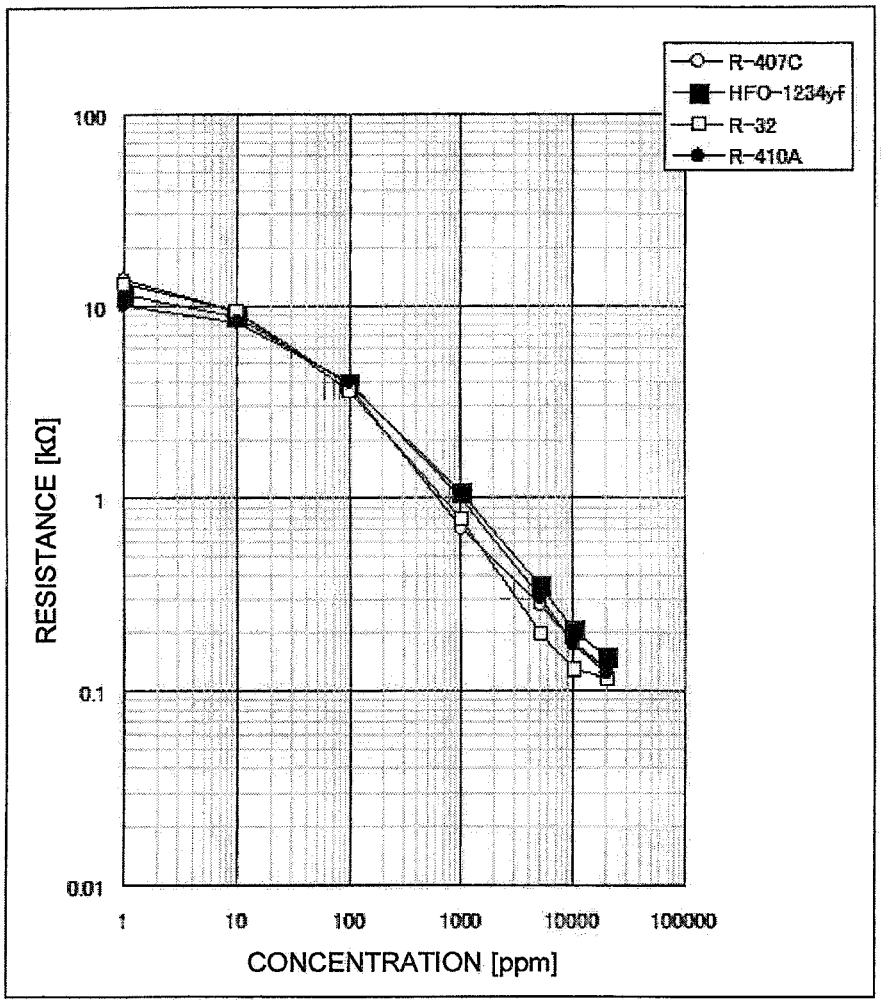
FIG. 6 is a diagram expressing the relationship between refrigerant concentration and the resistance value of the concentration detecting device 39.
Figure 11:
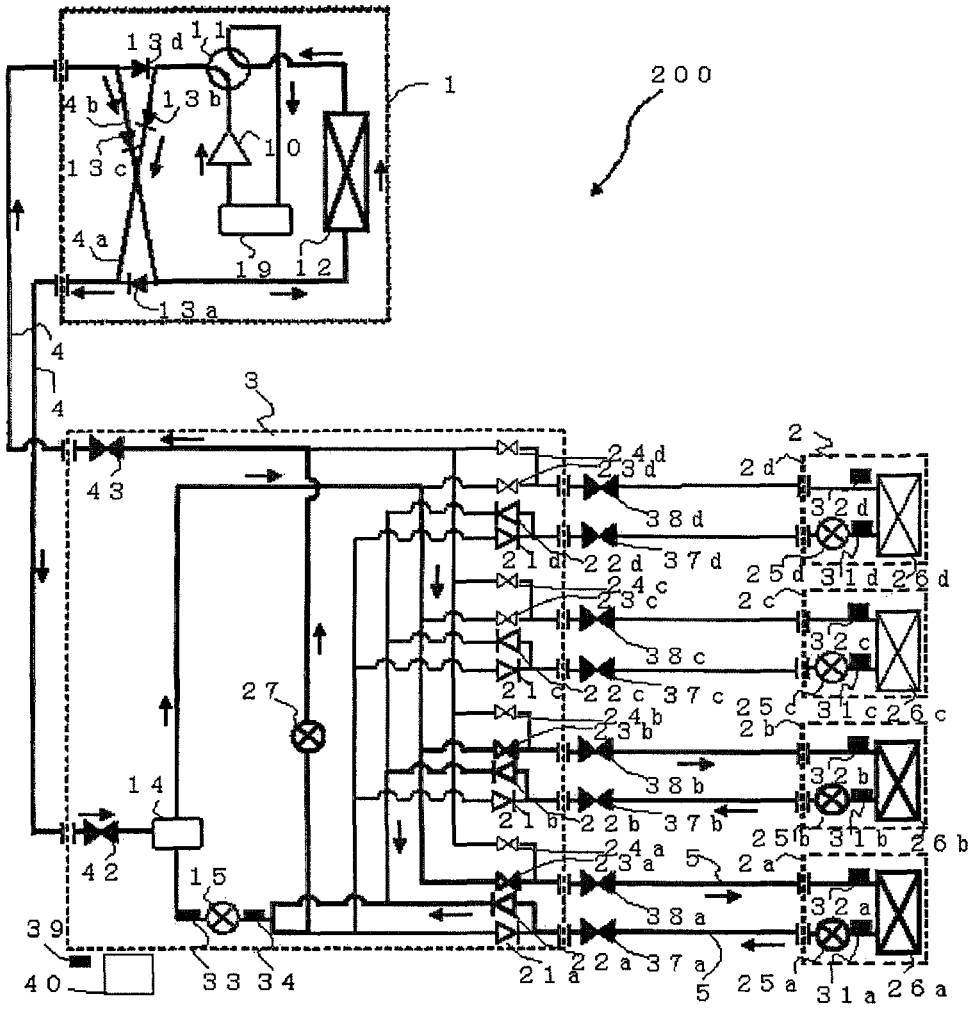
FIG. 11 is a refrigerant circuit diagram illustrating the flow of refrigerant during a heating only operation mode of the air-conditioning apparatus according to Embodiment 2 of the present invention.

FIG. 6 is a diagram expressing the relationship between the refrigerant concentration and the resistance value of the concentration detecting device 39. In the concentration detecting device 39 used in Embodiment 1, a detecting unit for detecting concentration includes a semiconductor, such that a leakage concentration is computed from resistance changes in the detecting unit. Herein, the semiconductor of the detecting unit is made of tin oxide ($SnO_2$). FIG. 6 shows that as the refrigerant concentration rises, the resistance value of the semiconductor gradually falls. For this reason, computing the resistance value of the concentration detecting device 39 enables to uniquely compute a refrigerant concentration. Herein, as illustrated in FIG. 6, a characteristic of using a tin oxide ($SnO_2$) semiconductor is that the major refrigerants R410A, R407C, R32, and HFO-1234yf exhibit nearly the same tendencies regarding the relationship between resistance and refrigerant concentration. For this reason, it is possible to detect refrigerant concentration by using the same calibration curve data for major refrigerants, for example. Since detecting a plurality of refrigerant concentrations using the same detecting unit becomes possible, it becomes possible to potentially standardize the concentration detecting device 39, and potentially lower the cost of the concentration detecting device 39. This eventually leads to the lower cost of the air-conditioning apparatus. The case of attempting to further improve the detection accuracy of the concentration detecting device 39 may be accommodated by creating data according to calibration curves for each refrigerant as illustrated in FIG. 11. In Embodiment 1, a detecting unit of the concentration detecting device 39 that utilizes this principle is at least installed in the non-air-conditioned space 8.

Next, each shutoff device will be described. Since the first shutoff device 42 and the second shutoff device 43 are installed on the main pipes 4, it is necessary to increase the valve opening diameter inside the shutoff devices (it is necessary to increase the CV value). Additionally, the third shutoff devices 37 and the fourth shutoff devices 38 are installed on the branch pipe 5 side of each branching device 16, and it is necessary to increase the valve opening diameter inside the shutoff devices (it is necessary to increase the CV value) in the case where one of the indoor units 2 has a large capacity (such as 4 horsepower (hp), for example).

Thus, in Embodiment 1, direct operated shutoff devices and pilot shutoff devices are used for the first shutoff device 42, the second shutoff device 43, the third shutoff devices 37, and the fourth shutoff devices 38 according to the size of the CV value. In addition, a material such as rubber or PTFE is used as the seal material for sealing the valve body. For example, the shutoff devices do not open and close frequently like ordinary valves, but rather shut off a flow only in emergencies. For this reason, it is necessary to use a seal material such as rubber or PTFE, which will readily conform to the valve body, instead of using a metallic seal material, although the metallic seals have more durability.

Since the first shutoff device 42 is installed on the liquid refrigerant side, a small CV value is acceptable. For an outdoor unit 1 with a capacity of approximately 10 hp, the CV is approximately 0.7 (0.3 or more), and a small, low-cost, direct operated first shutoff device 42 may be used. Similarly, since the third shutoff devices 37 are installed on the liquid refrigerant side, the CV is approximately 0.7 (0.05 or more) in cases where the capacity is less than 10 hp, and small, low-cost, direct operated third shutoff devices 37 may be used. On the other hand, since the second shutoff device 43 is installed on the gas refrigerant side, the CV value needs to be greater than that of the liquid refrigerant side. For example, for a capacity of approximately 10 hp, the CV is approximately 10 (4.7 or more), necessitating the use of a pilot shutoff device. Similarly, since the fourth shutoff devices 38 are installed on the gas refrigerant side, the CV is approximately 10 (0.75 or more) for a capacity of approximately 10 hp, necessitating the use of one to several pilot shutoff devices or direct operated shutoff devices.

Also, in order to quickly shut off the flow in an emergency, the minimum operating pressure differential of the first shutoff device 42, the second shutoff device 43, the third shutoff devices 37, and the fourth shutoff devices 38 must be a value that is sufficiently smaller than approximately 0 kPa.

At this point, since large amounts of leaking refrigerant create dangers such as combustion and oxygen shortage, for each type of refrigerant there is defined a concentration limit, which is the maximum concentration of a safely usable quantity of leaked refrigerant. The concentration limit is, for example, 0.44 $kg/m^3$ for R-410A, 0.061 $kg/m^3$ for R-32, 0.0578 $kg/m^3$ for HFO-1234yf, and 0.008 $kg/m^3$ for propane.

For example, consider closing the shutoff valve in a shutoff device installed on a refrigerant pipe to prevent further refrigerant leakage when the refrigerant leaks into a space. At this point, performing shutoff or the like after the refrigerant reaches the concentration limit would be too late. For this reason, the shutoff valve is made to close when the concentration of refrigerant inside the space reaches 95% of the concentration limit. Consequently, after the shutoff valve is closed, an additional 5% of the refrigerant quantity may still leak before the refrigerant reaches the concentration limit.

For example, assume that the expected installation location of a multi-air-conditioning system for a building is the smallest room, and that the indoor load per air-conditioning area is 0.15 $kW/m^2$ (citing the Air-conditioning and Sanitary Facilities Estimation Handbook, Ed. The Japan Quantity Survey Association). Then, in the case of installing an indoor unit with a performance of 1.5 kW, the value obtaining by dividing the 1.5 kW performance of the indoor unit by the 0.15 $kW/m^2$ indoor load per air-conditioning area becomes the room area, or 10.0 $m^2$. Additionally, multiplying the 10.0 $m^2$ area of that room by a room height of 2.5 m yields the volume of the room, or 25 $m^3$. Assuming that the pressure differential across a shutoff valve is 1.0 MPa when the shutoff valve is operated, and that the effective volume of the indoor space after subtracting the prefabricated bath and other objects is $0.5\times25=12.5$ $m^3$, the quantity of refrigerant that may still leak after closing the shutoff valve becomes $12.5\ m^3\times0.05=0.625\ m^3$. It is conceivable that an occupant may be in a sealed space with windows closed without becoming aware of the refrigerant leakage, such as while sleeping. For this reason, computing a leakage rate that does not reach the concentration limit within 24 hours after the shutoff devices operate yields $0.625/(24\times60\times60)=7.2\times10^{-6}$ $m^3/s$. If the leakage rate after closing the shutoff valves is less than this value, the leakage is safe.

Furthermore, the site where the refrigerant leaks cannot be specified in advance, and the refrigerant may leak from a high-pressure pipe with a high leakage rate. Assume that the above leakage rate must be secured for a pressure differential of approximately 5 MPa. From the commonly known Bernoulli's principle from fluid dynamics, the refrigerant leakage rate is proportional to the square root of the pressure differential, and thus the refrigerant leakage rate becomes $7.2\times10^{-6}\ m^3/s/(5/1)^{0.5}=3.2\times10^{-6}$. The leakage rate is safe if less than this value. Thus, for additional safety, assume that the leakage rate is to be kept to $1.0\times10^{-6}$ or less.

Figure 7:
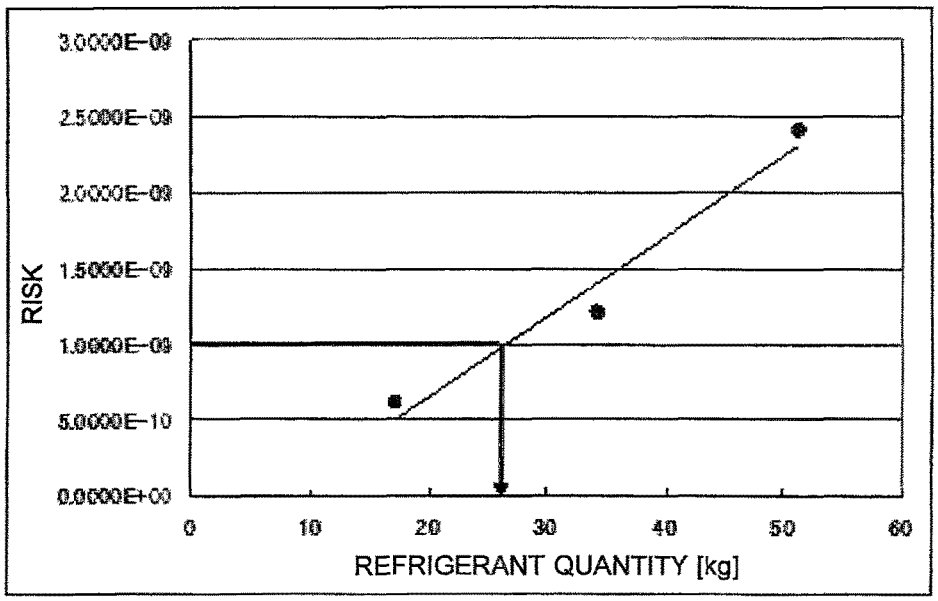
FIG. 7 is a diagram illustrating the relationship between refrigerant quantity and the risk of combustion.

FIG. 7 is a diagram illustrating the relationship between refrigerant quantity and the risk of combustion. A combustion risk assessment conducted for an industrial air-conditioner considering factors such as the installation state and usage of Embodiment 1 yielded the relationship illustrated in FIG. 7 between the refrigerant quantity and the risk of combustion. In FIG. 7, the horizontal axis represents the refrigerant quantity, while the vertical axis represents the risk. Herein, risk is expressed as a probability that combustion will occur. Typically, it is said that a risk is socially acceptable if less than $1.0\times10^{-7}$ (the risk of death by traffic accident is said to be $1.0\times10^{-5}$). In the case of aiming for a risk less than $1.0\times10^{-9}$, or the region where combustion almost never occurs, the refrigerant quantity must be less than 26 kg, as illustrated in FIG. 7. Furthermore, when considering the possibility of on-site overcharging by approximately 20% with respect to a target charged quantity, the charged target refrigerant quantity of approximately 20 kg is obtained in the case where the indoor spatial volume is 25 $m^3$. Consequently, the upper limit value for the charged quantity of refrigerant per unit volume in a direct expansion air-conditioning apparatus for industrial use, for example, becomes approximately the value obtained by dividing 20 kg by 25 $m^3$, or 0.800 $kg/m^3$.

Herein, FIG. 7 illustrates the risk when the refrigerant is R32. If the ratio 0.948 of the concentration limit 0.0578 $kg/m^3$ of HFO-1234yf to the concentration limit 0.061 $kg/m^3$ of R32 is multiplied by the charged refrigerant quantity limit 0.800 $kg/m^3$ of R32, the charged refrigerant quantity limit of HFO-1234yf becomes approximately 0.759 $kg/m^3$.

Also, for an R32/HFO refrigerant mixture, assume that the composition ratios of R32 and HFO-1234yf are 44% for R32 and 56% for HFO-1234yf, for example. After multiplying the respective composition ratios by the concentration limits for R32 and HFO-1234yf, the sum of the concentration limits according to the respective composition ratios becomes 0.0592 $kg/m^3$. If the ratio 0.971 of this sum of concentration limits 0.0592 $kg/m^3$ to the concentration limit 0.061 $kg/m^3$ of R32 is multiplied by the charged refrigerant quantity limit 0.800 $kg/m^3$ of R32, the charged refrigerant quantity limit of R32/HFO refrigerant mixture becomes approximately 0.777 $kg/m^3$.

Additionally, assume that the composition ratio of R32 is 73% and that of HFO-1234yf is 27%. After multiplying the respective composition ratios by the concentration limits for R32 and HFO-1234yf, the sum of the concentration limits according to the respective composition ratios becomes 0.0602 $kg/m^3$. If the ratio 0.987 of this sum of concentration limits 0.0602 $kg/m^3$ to the R32 concentration limit 0.061 $kg/m^3$ is multiplied by the charged refrigerant quantity limit 0.800 $kg/m^3$ of R32, the charged refrigerant quantity limit of R32/HFO refrigerant mixture becomes approximately 0.790 $kg/m^3$. This is nearly equal to the charged refrigerant quantity limit of approximately 0.759 $kg/m^3$ of HFO-1234yf and the charged refrigerant quantity limit of 0.800 $kg/m^3$ of R32.

Meanwhile, propane has a low concentration limit of 0.008 $kg/m^3$. If the ratio 0.131 to the R32 concentration limit 0.061 $kg/m^3$ is multiplied by the charged refrigerant quantity limit 0.800 $kg/m^3$ of R32, the charged refrigerant quantity limit becomes approximately 0.105 $kg/m^3$.

Thus, the third shutoff devices 37 and the fourth shutoff devices 38 are installed in the vicinity of the branching devices 16 in a system in which the value obtained by dividing the combined total of the refrigerant quantity inside the indoor units 2 and the refrigerant quantity inside the branch pipes 5 that connect the indoor units 2 and the branching devices 16 by the volume of the indoor space 7 exceeds the charged refrigerant quantity limit. Then, the spread of refrigerant into the indoor space 7 is prevented when the refrigerant leaks into the non-air-conditioned space 8 from the branch pipes 5.

In addition, it is necessary to install the first shutoff device 42 and the second shutoff device 43 in the vicinity of the branching devices 16 in a system in which the value obtained by dividing the combined total of the refrigerant quantity inside the main pipes 4 that connect the outdoor unit 1 and the branching devices 16 and the refrigerant quantity inside the outdoor unit 1 by the volume of the indoor space 7 exceeds the charged refrigerant quantity limit, and prevent the spread of refrigerant into the indoor space 7 when the refrigerant leaks into the non-air-conditioned space 8 from the outdoor unit 1 and the main pipes 4 connected to the outdoor unit 1.

Also, in the case where the volume of the indoor space 7 is 25 $m^3$, for example, the allowable refrigerant leakage quantity is calculated by multiplying the concentration limit for each refrigerant by the indoor space volume 25 $m^3$. For example, with R32, that is 20.0 kg or less, while with HFO-1234yf, that is approximately 18.98 kg or less. Also, with an R32/HFO mixture, that is approximately 19.43 kg or less in the case where the composition ratios of R32/HFO-1234yf are 44% for R32 and 56% for HFO-1234yf, for example. Additionally, the allowable refrigerant leakage quantity is approximately 19.75 kg or less in the case where the composition ratios of R32/HFO-1234yf are 73% for R32 and 27% for HFO-1234yf, while propane is approximately 2.63 kg.

Although the anticipated minimum indoor space volume is taken to be 25 $m^3$ herein, it is not limited thereto. For example, an even smaller space such as a server room or machine room where an indoor unit 2 is installed may be treated as the indoor space 7, and the charged refrigerant quantity limit in $kg/m^3$ is still applicable to a spatial volume of 25 $m^3$ or less. Even with a space which has an indoor unit 2 installed and which is smaller than the anticipated minimum indoor space volume of 25 $m^3$, the concentration detecting device 39 and respective shutoff devices are installed above the ceiling, and safety can be ensured.

For example, assume that the refrigerant quantity in the outdoor unit 1 is 8.0 kg for an outdoor unit capacity from 5 hp to 8 hp, 10.5 kg from 9 hp to 14 hp, 11.5 kg from 15 hp to 18 hp, 13.0 kg from 19 hp to 20 hp, 18.0 kg from 21 hp to 28 hp, and 20.0 kg or more for 29 hp or more. Assume that the refrigerant quantity in an indoor unit 2 is 3.0 kg for 10 hp or less, 5.0 kg for 10 hp to 25 hp, 9.0 kg for 25 hp to 25 hp, and 14.0 kg for 36 hp or more.

The allowable refrigerant leakage quantity will now be described for the case where the refrigerant leaks into the non-air-conditioned space 8 and also spreads to the indoor space 7 due to brazing failure or the like in the branching devices 16. For example, assume that M1 (kg) is the refrigerant quantity of the outdoor unit 1 corresponding to the capacity of the outdoor unit 1, that M2 (kg) is the indoor unit refrigerant quantity corresponding to the total capacity of the indoor units 2, and that n is the number of indoor units 2 (number of branches). Also assume that D1 (m) is the diameter of the main pipe 4 on the liquid side, that D2 (m) is the diameter of the branch pipe 5 on the liquid side, that L1 (m) is the length of the main pipes 4 (the distance between the outdoor unit 1 and the inlets of the branching devices 16), and that L2 (m) is the average length of the branch pipes 5 (the distance of the branch pipes 5 from the outlets of the branching devices 16 to the inlets of the indoor units 2). Furthermore, assume that V1 ($m^3$) is the volume of the indoor space 7, and that $\rho\approx981$ $kg/m^3$ is the refrigerant liquid density (the liquid density for the case of R32 refrigerant with an outside average temperature of 20 degrees C. is taken as an example, the value differs depending on the refrigerant used), the above-assumptions provide Eqs. 1-1 to 1-3 (all units in kg). Then, if attempting to construct an air-conditioning apparatus that satisfies Eq. 1-1, the first shutoff device 42 and the second shutoff device 43 are required. Also, if attempting to construct an air-conditioning apparatus that satisfies Eq. 1-2, installation of the third shutoff devices 37 and the fourth shutoff devices 38 is required. In addition, if attempting to construct an air-conditioning apparatus that satisfies Eq. 1-3, the first shutoff device 42, the second shutoff device 43, the third shutoff devices 37, and the fourth shutoff devices 38 are required.

$$\{M1+(D1/2)^2\times\pi\times\rho\times L1\}<\{0.8\times V1\} \quad (1\text{-}1)$$

$$\{M2+(D2/2)^2\times\pi\times n\times\rho\times L2\}<\{0.8\times V1\} \quad (1\text{-}2)$$

$$(\text{left-hand side of Eq. 1-1})+(\text{left-hand side of Eq. 1-2})<\{0.8\times V1\} \quad (1\text{-}3)$$

For example, assuming that the outdoor unit capacity is 18 hp, n=10, D1=13.88 (outer diameter 15.88, wall thickness 1.0) mm, L1=100 m, D2=7.92 (outer diameter 9.52, wall thickness 0.8) mm, and V1=25.0 $m^3$, the limit of the refrigerant charged quantity of 20.0 kg is obtained according to the right-hand sides of Eqs. 1-1 to 1-3. Calculating L2 on the left-hand side of Eq. 1-2 so as to satisfy the right-hand side of Eq. 1-2 provides L2<31.0 m. Using this L2 to calculate the total refrigerant quantity in the branch pipes 5 and the indoor units 2 provides approximately 19.99 kg<20.0 kg according to the left-hand side of Eq. 1-2. Also, the total refrigerant quantity of the main pipes 4 and the outdoor unit 1 of approximately 26.35 kg>20.0 kg is obtained according to the left-hand side of Eq. 1-1. The total refrigerant quantity of the air-conditioning apparatus of 46.34 kg>20.0 kg is obtained according to the left-hand side total in Eq. 1-3. Since the total refrigerant quantity of the main pipes 4 and the outdoor unit 1 of approximately 26.35 kg>20.0 kg is obtained according to the left-hand side of Eq. 1-1, shutoff devices on the side of the outdoor unit 1 and the main pipes 4, that is, the first shutoff device 42 and the second shutoff device 43 are required. Meanwhile, if L2>31.0 m, the total refrigerant quantity of the branch pipes 5 and the indoor units 2 of approximately 20.04 kg>20.0 kg is obtained according to the left-hand side of Eq. 1-2, and thus the installation of shutoff devices on the side of the branch pipes 5 and the indoor units 2, that is, the third shutoff devices 37 and the fourth shutoff devices 38, is also required.

Also, in the case where the capacity of the outdoor unit 1 is 18 hp, n=10, D1=13.88 (outer diameter 15.88, wall thickness 1.0) mm, D2=7.92 (outer diameter 9.52, wall thickness 0.8) mm, L2=35.0 m, and V1=25.0 $m^3$, the refrigerant charged quantity limit of 20.0 kg is obtained according to the right-hand sides of Eqs. 1-1 to 1-3. Calculating L1 on the left-hand side of Eq. 1-1 so as to satisfy the right-hand side of Eq. 1-1 provides L1<57.0 m. Additionally, using L1 to calculate the total refrigerant quantity in the main pipes 4 and the outdoor unit 1 provides approximately 19.97 kg<20.0 kg according to the left-hand side of Eq. 1-1. Also, the total refrigerant quantity of the branch pipes 5 and the indoor units 2 of 21.93 kg>20.0 kg is obtained according to the left-hand side of Eq. 1-2. The total refrigerant quantity of the air-conditioning apparatus of 41.9 kg>20.0 kg is obtained according to the left-hand-side total in Eq. 1-3. Since the total refrigerant quantity in the branch pipes 5 and the indoor units 2 is 21.93 kg>20.0 kg according to the left-hand side of Eq. 1-2, the installation of the third shutoff devices 37 and the fourth shutoff devices 38 on the branch pipes 5 is required. Meanwhile, if L1>57.0 m, the total refrigerant quantity of the main pipes 4 and the outdoor unit 1 of 20.1 kg>20.0 kg is obtained according to the left-hand side of Eq. 1-1, and thus the installation of shutoff devices on the side of the main pipes 4 and the outdoor unit 1, that is, the first shutoff device 42 and the second shutoff device 43, is also required.

Also, in the case where the outdoor unit capacity is 18 hp, n=10, D1=13.88 (outer diameter 15.88, wall thickness 1.0) mm, L1=50 m, D2=7.92 (outer diameter 9.52, wall thickness 0.8) mm, L2=15.0 m, and V1=25.0 $m^3$, the limit of the refrigerant charged quantity of 20.0 kg is obtained according to the right-hand sides of Eqs. 1-1 to 1-3. The total refrigerant quantity in the main pipes 4 and the outdoor unit 1 is approximately 18.93 kg<20.0 kg according to the left-hand side of Eq. 1-1, while the total refrigerant quantity in the branch pipes 5 and the indoor units 2 is approximately 12.3 kg<20.0 kg according to the left-hand side of Eq. 1-2. Since the total refrigerant quantity in the air-conditioning apparatus is 31.23 kg>20.0 kg according to the left-hand-side total in Eq. 1-3, it is necessary to install either the first shutoff device 42 and the second shutoff device 43, or the third shutoff devices 37 and the fourth shutoff devices 38. Additionally, all of the first shutoff device 42, the second shutoff device 43, the third shutoff devices 37, and the fourth shutoff devices 38 may also be installed in the above example in order to further raise safety for the refrigerant leakage quantity.

At this point, in the case where shutoff devices (not illustrated; assume a fifth shutoff device and a sixth shutoff device, for example) are installed at positions in the vicinity of the indoor units 2, for example, the refrigerant quantity in the branch pipes 5 may be calculated by setting M2 to 0 kg in Eq. 1-2. Also, the constant 0.8 on the right-hand sides of Eqs. 1-1 to 1-3 is the charged refrigerant quantity limit. At this point, R32 is 0.800 kg/$m^3$, and HFO-1234yf is approximately 0.759 kg/$m^3$. Also, an R32/HFO mixture is approximately 0.777 kg/$m^3$ in the case where the composition ratios of R32/HFO-1234yf are 44% for R32 and 56% for HFO-1234yf, for example. Additionally, the charged refrigerant quantity limit is 0.790 kg/$m^3$ in the case where R32 is 73% and HFO-1234yf is 27%. Also, propane is approximately 0.105 kg/$m^3$.

Next, the installation positions of the first shutoff device 42 and the second shutoff device 43 as well as the installation positions of the third shutoff devices 37 and the fourth shutoff devices 38 will be described. Assuming that L3 (m) is the installation length of the first shutoff device 42 and the second shutoff device 43 (the distance from the shutoff devices to the inlets of the branching devices 16) and that L4 (m) is the installation length of the third shutoff devices 37 and the fourth shutoff devices 38 (the distance from the shutoff devices to the inlets of the branching devices 16), this provides Eqs. 2-1 to 2-3 (all units in kg).

Then, in the case of attempting to install the first shutoff device 42 and the second shutoff device 43, the first shutoff device 42 and the second shutoff device 43 are installed within an L3 (m) that satisfies Eq. 2-1.

$$\{(D1/2)^2\times\pi\times\rho\times L3\}+\{M2+(D2/2)^2\times n\times\pi\times\rho\times L2\}<0.8\times V1 \quad (2\text{-}1)$$

For example, assume that the outdoor unit capacity is 18 hp, n=10, D1=13.88 (outer diameter 15.88, wall thickness 1.0) mm, D2=7.92 (outer diameter 9.52, wall thickness 0.8) mm, L2=30 m, and V1=25.0 $m^3$. Then, in the case of attempting to install the first shutoff device 42 and the second shutoff device 43 on the main pipes 4, the limit of the refrigerant charged quantity of 20.0 kg is obtained according to the right-hand side of Eq. 2-1, and calculating L3 on the left-hand side of Eq. 2-1 so as to satisfy Eq. 2-1 provides L3 less than approximately 3.3 m. For this reason, it is necessary to install the first shutoff device 42 and the second shutoff device 43 such that the distance L3 from the first shutoff device 42 and the second shutoff device 43 to the inlets of the branching devices 16 is within approximately 3.3 m.

Also, in the case of attempting to install only the third shutoff devices 37 and the fourth shutoff devices 38, the third shutoff devices 37 and the fourth shutoff devices 38 are installed within an L4 (m) that satisfies Eq. 2-2.

$$\{(D1/2)^2\times\pi\times\rho\times L1+M1\}+\{(D2/2)^2\times n\times\pi\times\rho\times L4\}<0.8\times V1 \quad (2\text{-}2)$$

For example, assume that the outdoor unit capacity is 18 hp, n=10, D1=13.88 (outer diameter 15.88, wall thickness 1.0) mm, D2=7.92 (outer diameter 9.52, wall thickness 0.8) mm, L1=55.0 m, and V1=25.0 $m^3$. Then, in the case of attempting to install the third shutoff devices 37 and the fourth shutoff devices 38 on the branch pipes 5, the limit of the refrigerant charged quantity of 20.0 kg is obtained according to the right-hand side of Eq. 2-2, and calculating L4 on the left-hand side of Eq. 2-2 so as to satisfy Eq. 2-2 provides L4<0.6 m. For this reason, it is necessary to install the third shutoff devices 37 and the fourth shutoff devices 38 such that the distance L4 from the third shutoff devices 37 and the fourth shutoff devices 38 to the inlets of the branching devices 16 is within 0.6 m.

Also, in the case of attempting to install all of the first shutoff device 42, the second shutoff device 43, the third shutoff devices 37, and the fourth shutoff devices 38, the first shutoff device 42 and the second shutoff device 43 are installed within an L3 (m), and the third shutoff devices 37 and the fourth shutoff devices 38 are installed within an L4 (m), that satisfy Eq. 2-3.

$$(D1/2)^2\times\pi\times\rho\times L3+(D2/2)^2\times n\times\pi\times\rho\times L4<0.8\times V1 \quad (2\text{-}3)$$

For example, assume that the outdoor unit capacity is 18 hp, n=10, D1=13.88 (outer diameter 15.88, wall thickness 1.0) mm, D2=7.92 (outer diameter 9.52, wall thickness 0.8) mm, L1=100.0 m, L2=50.0 m, and V1=25.0 $m^3$. The limit of the refrigerant charged quantity of 20.0 kg is then obtained according to the right-hand side of Eq. 2-3. In addition, the refrigerant quantity inside the indoor units 2 and the branch pipes 5 of approximately 29.18 kg>20.0 kg is obtained according to the second term enclosed in { } on the left-hand side of Eq. 2-1. Also, the refrigerant quantity inside the outdoor unit 1 and the main pipes 4 of 26.35 kg>20.0 kg is obtained according to the first term enclosed in { } on the left-hand side of Eq. 2-2. The first shutoff device 42 and the second shutoff device 43 are required on the main pipes 4, while the third shutoff devices 37 and the fourth shutoff devices 38 are required on the branch pipes 5.

At this point, if the first shutoff device 42 and the second shutoff device 43 are installed on the main pipes 4 with L3<70.0 m, and if the third shutoff devices 37 and the fourth shutoff devices 38 are installed on the branch pipes 5 with L4<19.8 m, then according to the left-hand side of Eq. 2-3, the refrigerant quantity inside the pipes respectively connected to each shutoff device of approximately 19.97 kg<20.0 kg is to be obtained. Consequently, the first shutoff device 42 and the second shutoff device 43 may be installed on the main pipes 4 with L3<70.0 m, and the third shutoff devices 37 and the fourth shutoff devices 38 may be installed on the branch pipes 5 with L4<19.8 m. Also, since each shutoff device is installed in the non-air-conditioned space 8, in the case where the computed distance of L3 extends out of the non-air-conditioned space 8 and enters the outdoor space 6, the first shutoff device 42 and the second shutoff device 43 installed on the main pipes 4 may be installed at installation positions between the main pipes 4 immediately entering the non-air-conditioned space 8 from the outdoor space 6, and the branching devices 16.

At this point, in the case where shutoff devices (not illustrated; assume a fifth shutoff device and a sixth shutoff device, for example) are installed at positions in the vicinity of the indoor units 2, for example, the distance L3 may be calculated by setting M2 to 0 kg in Eq. 2-2. Also, the constant 0.8 on the right-hand sides of Eqs. 2-1 to 2-3 is the charged refrigerant quantity limit. At this point, R32 is 0.800 kg/$m^3$, and HFO-1234yf is approximately 0.759 kg/$m^3$. Also, an R32/HFO mixture is approximately 0.777 kg/$m^3$ in the case where the composition ratios of R32/HFO-1234yf are 44% for R32 and 56% for HFO-1234yf, for example. Additionally, the charged refrigerant quantity limit is 0.790 kg/$m^3$ in the case where R32 is 73% and HFO-1234yf is 27%. Also, propane is approximately 0.105 kg/$m^3$.

By installing the first shutoff device 42, the second shutoff device 43, the third shutoff devices 37, and the fourth shutoff devices 38 at positions determined on the basis of calculations above, when the refrigerant leaks into the non-air-conditioned space 8 from the outdoor unit 1, the main pipes 4, the branch pipes 5, or the indoor units 2, the refrigerant leakage quantity that spreads to the indoor space 7 may be suppressed to less than or equal to a limit value for the refrigerant leakage quantity allowable by the indoor space 7 (the refrigerant charged quantity limit or less).

As above, according to an air-conditioning apparatus of Embodiment 1, for a refrigerant leak from a refrigerant circuit, if the shutoff valve control device 40 determines that the refrigerant has leaked on the basis of a refrigerant concentration detected by the concentration detecting device 39 in a non-air-conditioned space 8 such as above the ceiling, for example, the first shutoff device 42, the second shutoff device 43, the third shutoff devices 37, and the fourth shutoff devices 38 are made to shut off the flow of refrigerant. Accordingly, the refrigerant leakage in the non-air-conditioned space 8 is minimized, the spread of refrigerant to the air-conditioned space is prevented, therefore, not only the safety is greatly improved, but also the environmental load is reduced.

Also, since the pipes on which the shutoff devices are installed are determined on the basis of the refrigerant quantity in the outdoor unit 1 and the main pipes 4, the refrigerant quantity in the indoor units 2 and the branch pipes 5, and the volume of the indoor space 7, it is possible to efficiently install the shutoff devices while taking into account the effects of refrigerant leakage from the non-air-conditioned space 8 into the indoor space 7. Also, since the distances from the branching devices 16 to the main pipes 4 and the branch pipes 5 are determined on the basis of the refrigerant quantity therebetween, the volume of the indoor space 7, and the refrigerant charged quantity limit value, it is possible to install the shutoff devices at positions that take into account the effects of refrigerant leakage from the non-air-conditioned space 8 into the indoor space 7.

Embodiment 2

Figure 8:
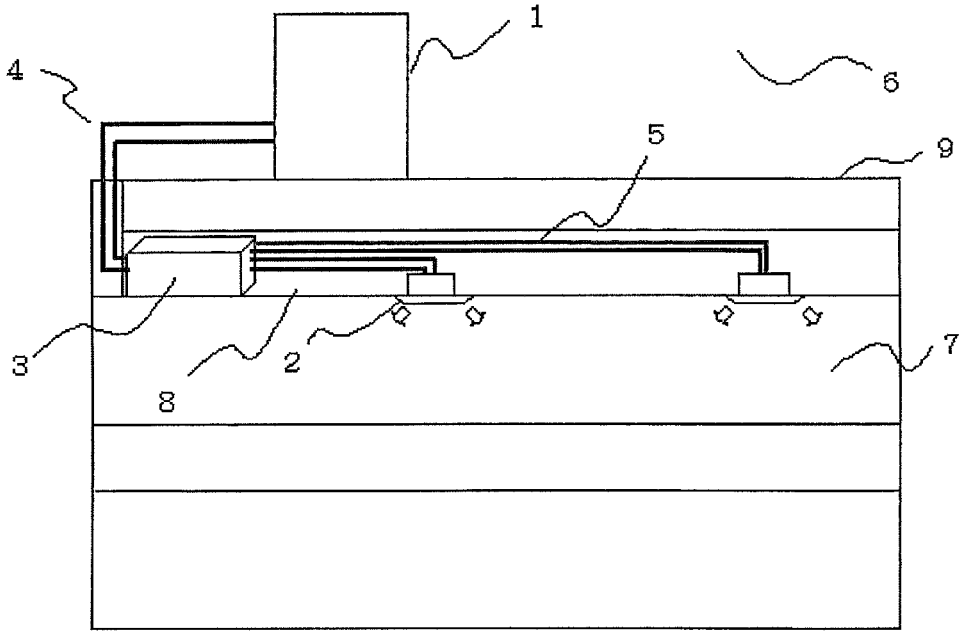
FIG. 8 is a schematic diagram illustrating an exemplary installation of an air-conditioning apparatus according to Embodiment 2 of the present invention.

FIG. 8 is a diagram illustrating an exemplary installation of an air-conditioning apparatus according to Embodiment 2 of the present invention. An exemplary installation of an air-conditioning apparatus according to Embodiment 2 will be described with reference to FIG. 8. The air-conditioning apparatus is an apparatus that circulates the refrigerant and performs air conditioning utilizing a refrigeration cycle. Additionally, each indoor unit is able to freely select cooling or heating. In FIG. 8 and subsequent drawings, components or the like assigned the same signs as in FIGS. 1, 2, and the like denote similar operation and the like as described in Embodiment 1.

As illustrated in FIG. 8, the air-conditioning apparatus according to Embodiment 2 includes one outdoor unit 1 which is a heat source device, and a plurality of indoor units 2. Additionally included is a relay unit 3 (hereinafter referred to as the relay unit 3) including first opening and closing device 23 and second opening and closing device 24 between the outdoor unit 1 and the indoor units 2 (see FIG. 9). The relay unit 3 controls the flow of refrigerant in order to supply the gas refrigerant to indoor units 2 performing heating, and supply the liquid refrigerant to indoor units 2 performing cooling. Herein, in Embodiment 2, the first shutoff device 42, the second shutoff device 43, the third shutoff devices 37, and the fourth shutoff devices 38 described in Embodiment 1 are provided in the vicinity of the relay unit 3.

As illustrated in FIG. 8, construction becomes facilitated by respectively connecting the outdoor unit 1 and the relay unit 3 using two main pipes 4, and connecting the relay unit 3 and each of the indoor units 2 using two branch pipes 5. Also, although in FIG. 8 the relay unit 3 is installed in the non-air-conditioned space 8 similarly to the branching devices 16 of Embodiment 1, installation is also possible in a shared space containing an elevator or the like, for example.

Figure 9:
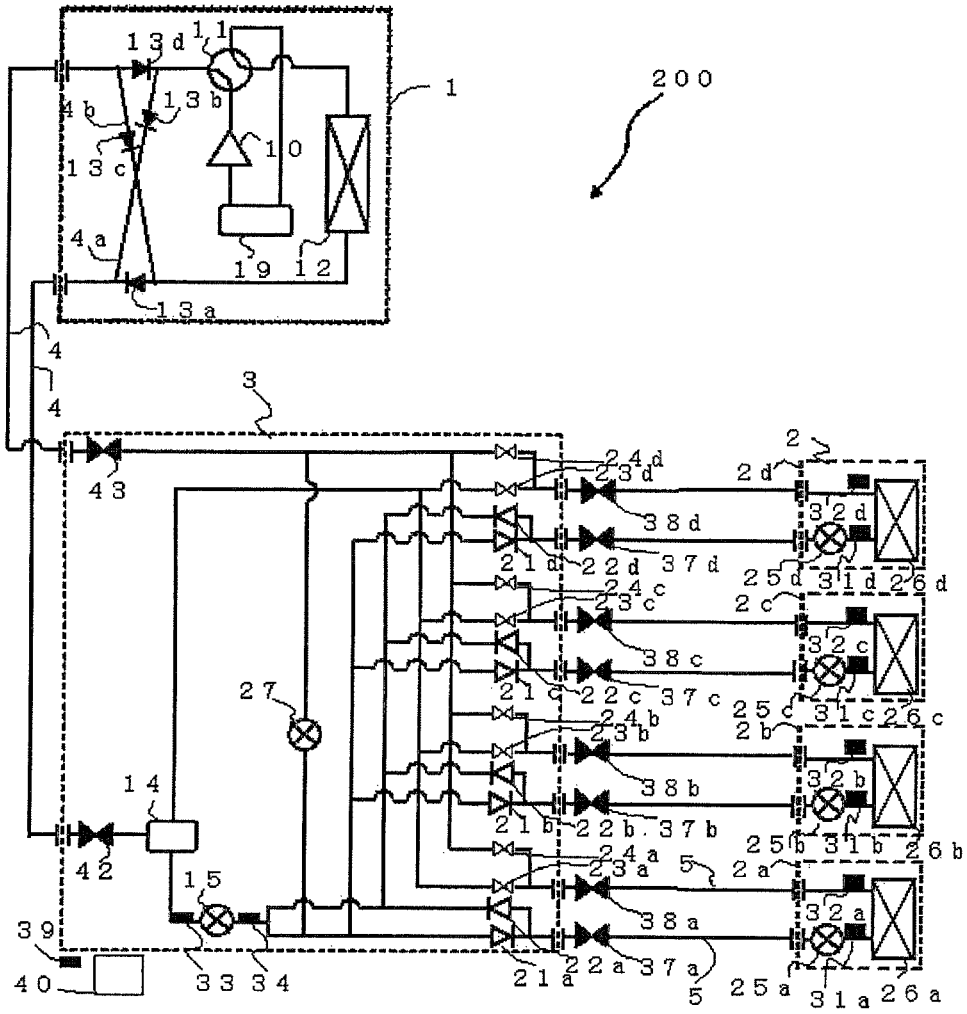
FIG. 9 is a diagram illustrating an exemplary configuration of an air-conditioning apparatus 100 according to Embodiment 2 of the present invention.

FIG. 9 is a diagram illustrating an exemplary configuration of an air-conditioning apparatus 200 according to Embodiment 2. A detailed configuration of the air-conditioning apparatus 200 will be described with reference to FIG. 9. As illustrated in FIG. 9, the outdoor unit 1 and the relay unit 3 are connected by main pipes 4. Also, the relay unit 3 and each of the indoor units 2 are connected by branch pipes 5.

(Outdoor Unit 1)

Similarly to Embodiment 1, the outdoor unit 1 of Embodiment 2 includes a compressor 10, a refrigerant flow switching device 11 such as a four-way valve, a heat source side heat exchanger 12, and an accumulator 19. Also provided are a first connecting pipe 4*a*, a second connecting pipe 4*b*, a first check valve 13*a*, a first check valve 13*b*, a first check valve 13*c*, and a first check valve 13*d*. Providing the first connecting pipe 4*a*, the second connecting pipe 4*b*, the first check valve 13*a*, the first check valve 13*b*, the first check valve 13*c*, and the first check valve 13*d* makes it possible to keep the flow of refrigerant circulating into the relay unit 3 going in a fixed direction, regardless of the operation demanded by the indoor units 2.

(Indoor Units 2)

The configuration of each of the indoor units 2 in Embodiment 2 is a similar configuration to the indoor units 2 described in Embodiment 1. Herein, the expansion devices 25 described in Embodiment 1 will be described as first expansion devices 25.

(Relay Device 3)

The relay unit 3 includes a gas liquid separator 14, a second expansion device 15, a third expansion device 27, four first opening and closing devices 23 (23*a* to 23*d*), four second opening and closing devices 24 (24*a* to 24*d*), four second check valves 21 (21*a* to 21*d*), and four third check valves 22 (22*a* to 22*d*).

The gas liquid separator 14 is installed at the inlet of the relay unit 3 via the first shutoff device 42. Also, in a cooling main operation mode as discussed later, the gas liquid separator 14 separates the high pressure two-phase refrigerant generated at the outdoor unit 1 into the liquid refrigerant and the gas refrigerant. The liquid refrigerant flows through the lower pipes on the page in FIG. 9, and supplies cooling energy to the indoor units 2. Meanwhile, the gas refrigerant flows through the upper pipes in FIG. 9, and supplies heating energy to the indoor units 2.

The second expansion device 15 has a function as a pressure reducing valve or opening and closing valve, adjusting the liquid refrigerant to a predetermined pressure by reducing its pressure, or opening and closing the liquid refrigerant flow. The second expansion device 15 is provided on a pipe below the gas liquid separator 14 on the page in FIG. 9, into which the liquid refrigerant flows. The second expansion device 15 may include a device that variably controls the opening degree such as an electronic expansion valve or the like.

The third expansion device 27 has a function as a pressure reducing valve or opening and closing valve, and in the heating only operation mode discussed later, opens and closes the refrigerant flow to bypass the refrigerant or the like. Also, in the heating main operation mode discussed later, the third expansion device 27 adjusts a bypass flow rate according to the indoor-side load. The third expansion device 27 is installed between a low pressure pipe that communicates on the outlet side of the relay unit 3, and a high pressure pipe that communicates on the outlet side of the second expansion device 15. The third expansion device 27 likewise may include a device that variably controls the opening degree such as an electronic expansion valve or the like.

The four first opening and closing devices 23 (the first opening and closing device 23*a* to the first opening and closing device 23*d*) includes solenoid valves, for example, opening and closing flows of the high temperature and high pressure gas refrigerant supplied to the indoor units 2. The number of provided first opening and closing devices 23 corresponds to the number of installed indoor units 2 (herein, four). The first opening and closing devices 23 are connected to gas pipes connected to the gas liquid separator 14. Herein, a first opening and closing device 23*a*, a first opening and closing device 23*b*, a first opening and closing device 23*c*, and a first opening and closing device 23*d* are illustrated from the bottom of the page, in correspondence with each of the indoor units 2.

The four second opening and closing devices 24 (the second opening and closing device 24*a* to the second opening and closing device 24*d*) includes solenoid valves, for example, opening and closing flows of the low pressure and low temperature gas refrigerant flowing out of the indoor units 2. The number of provided second opening and closing devices 24 corresponds to the number of installed indoor units 2 (herein, four). The second opening and closing devices 24 are connected to low pressure pipes that communicate on the outlet side of the relay unit 3. Herein, a second opening and closing device 24*a*, a second opening and closing device 24*b*, a second opening and closing device 24*c*, and a second opening and closing device 24*d* are illustrated from the bottom of the page, in correspondence with each of the indoor units 2.

The four second check valves 21 (the second check valve 21*a* to the second check valve 21*d*) are valves that allow the high pressure liquid refrigerant for cooling to flow into indoor units 2 performing cooling. The number of provided second check valves 21 corresponds to the number of installed indoor units 2 (herein, four). The second check valves 21 are connected to pipes on the refrigerant flow outlet side of the second expansion device 15. Herein, a second check valve 21*a*, a second check valve 21*b*, a second check valve 21*c*, and a second check valve 21*d* are illustrated from the bottom of the page, in correspondence with each of the indoor units 2.

The four third check valves 22 (the third check valve 22*a* to the third check valve 22*d*) are valves that circulate the refrigerant from the side of the indoor units 2, for example, and prevent backflow. The number of provided third check valves 22 corresponds to the number of installed indoor units 2 (herein, four). The third check valves 22 are provided on the side of the refrigerant flows positioned lower on the page in FIG. 9, and are connected to pipes on the refrigerant flow outlet side of the second expansion device 15. Herein, a third check valve 22*a*, a third check valve 22*b*, a third check valve 22*c*, and a third check valve 22*d* are illustrated from the bottom of the page, in correspondence with each of the indoor units 2.

Also, the relay unit 3 is provided with a first pressure sensor 33 and a second pressure sensor 34 as pressure detecting means. The first pressure sensor 33 is provided on the inlet side of the second expansion device 15, while the second pressure sensor 34 is provided on the outlet side of the second expansion device 15. The first pressure sensor 33 detects the pressure of high pressure refrigerant, while the second pressure sensor 34 detects the intermediate pressure of liquid refrigerant at the outlet of the second expansion device 15 during the cooling main operation mode.

Next, the operation modes performed by the air-conditioning apparatus 200 will be described. The air-conditioning apparatus 200 is capable of a cooling operation or a heating operation with the indoor units 2, on the basis of instructions from each of the indoor units 2. For this reason, the air-conditioning apparatus 200 is configured such that all indoor units 2 may perform the same operation and yet each of the indoor units 2 may perform different operations.

The operation modes performed by the air-conditioning apparatus 200 include a cooling only operation mode in which all operating indoor units 2 perform the cooling operation, a heating only operation mode in which all driven indoor units 2 perform the heating operation, a cooling main operation mode as a cooling and heating mixed operation mode in which the cooling load is larger, and a heating main operation mode as a cooling and heating mixed operation mode in which the heating load is larger. Hereinafter, the respective operation modes will be described.

(Cooling Only Operation Mode)

Figure 10:
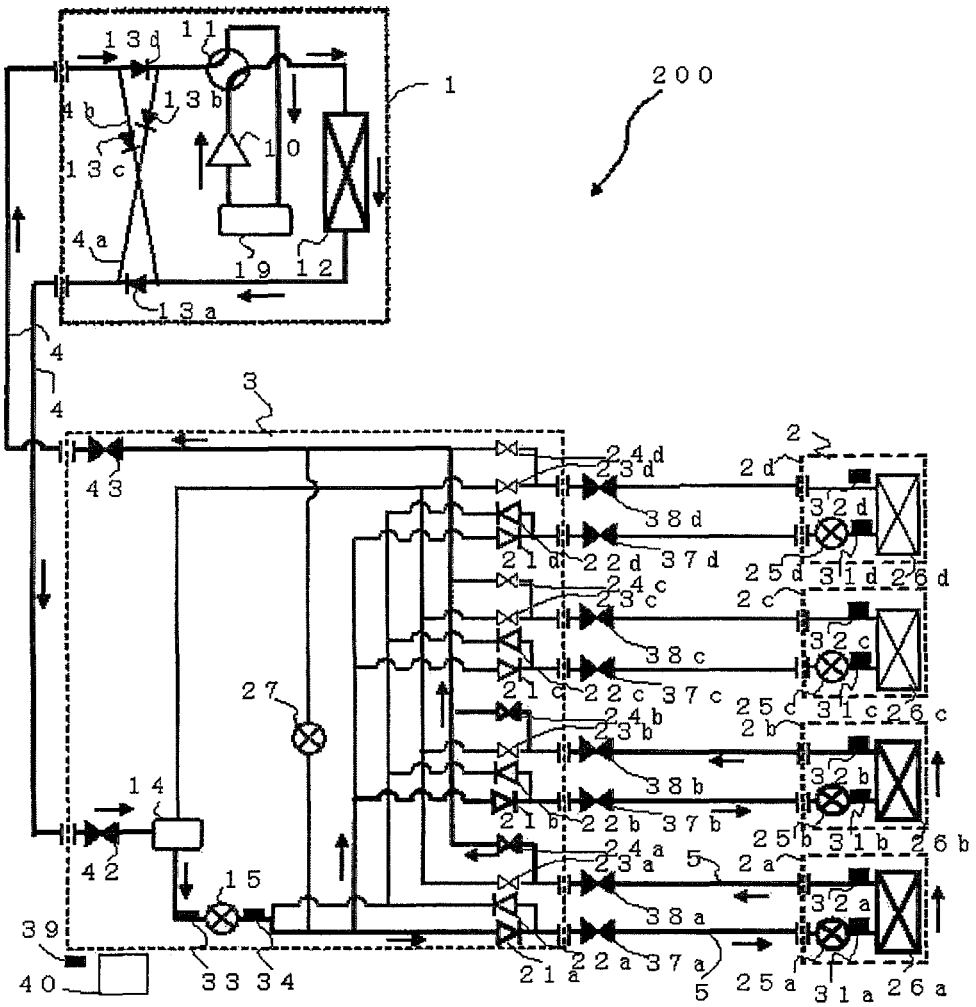
FIG. 10 is a refrigerant circuit diagram illustrating the flow of refrigerant during a cooling only operation mode of the air-conditioning apparatus according to Embodiment 2 of the present invention.

FIG. 10 is a refrigerant circuit diagram illustrating the flow of refrigerant during a cooling only operation mode of the air-conditioning apparatus 200. The cooling only operation mode will be described with reference to FIG. 10, taking as an example the case where a cooling load is generated by only the use side heat exchanger 26*a* and the use side heat exchanger 26*b*. In FIG. 10 herein, pipes indicated in bold represent pipes through which the refrigerant flows, while solid-line arrows represent the direction in which the refrigerant flows.

In the case of the cooling only operation mode illustrated in FIG. 10, in the outdoor unit 1, the refrigerant flow switching device 11 switches such that heat source side refrigerant discharged from the compressor 10 flows into the heat source side heat exchanger 12. The low temperature and low pressure refrigerant is compressed by the compressor 10 to become the high temperature and high pressure gas refrigerant, and is discharged. The high temperature and high pressure gas refrigerant discharged from the compressor 10 flows into the heat source side heat exchanger 12 via the refrigerant flow switching device 11. The refrigerant then becomes the high pressure liquid refrigerant while transferring heat to the outside air in the heat source side heat exchanger 12. The high pressure liquid refrigerant flowing out of the heat source side heat exchanger 12 flows out of the outdoor unit 1 through the first check valve 13*a*, and flows into the relay unit 3 via the main pipe 4 on the high pressure refrigerant side. The high pressure liquid refrigerant flowing into the relay unit 3, after passing through the first shutoff device 42, the gas liquid separator 14, the second expansion device 15, the second check valves 21, the third shutoff devices 37, and the branch pipes 5, is expanded by the expansion devices 25 to become the low temperature and low pressure two-phase refrigerant. The two-phase refrigerant respectively flows into the use side heat exchanger 26*a* and the use side heat exchanger 26*b* serving as evaporators, and becomes the low temperature and low pressure gas refrigerant while cooling indoor air by taking away heat from the indoor air. The gas refrigerant flowing out of the use side heat exchanger 26*a* and the use side heat exchanger 26*b* passes through the branch pipes 5, the fourth shutoff devices 38, the second opening and closing devices 24, and the second shutoff device 43, and flows out of the relay unit 3. Then, the gas refrigerant passes through the main pipe 4 on the low pressure refrigerant side and once again flows into the outdoor unit 1. The refrigerant flowing into the outdoor unit 1 passes through the first check valve 13*d* and is once again suctioned into the compressor 10 via the refrigerant flow switching device 11 and the accumulator 19.

At this point, the opening degree of the expansion device 25*a* is controlled such that the superheat (degree of superheat) obtained as the difference between the temperature detected by the first temperature sensor 31*a* and the temperature detected by the second temperature sensor 32*a* becomes constant. Similarly, the opening degree of the expansion device 25*b* is controlled such that the superheat (degree of superheat) obtained as the difference between the temperature detected by the first temperature sensor 31*b* and the temperature detected by the second temperature sensor 32*a* becomes constant.

Meanwhile, for the use side heat exchanger 26*c* and the use side heat exchanger 26*d* without a cooling load, there is no need to circulate the refrigerant, and the respectively corresponding expansion device 25*c* and expansion device 25*d* are closed. Furthermore, in the case where a cooling load is generated from the use side heat exchanger 26*c* or the use side heat exchanger 26*d*, the expansion device 25*c* or the expansion device 25*d* may be opened to allow the circulation of refrigerant. The opening degree of the expansion device 25*c* or the expansion device 25*d* is controlled such that the superheat (degree of superheat) obtained as the difference between the temperature detected by the first temperature sensor 31*c* or 31*d* and the temperature detected by the second temperature sensor 32*c* or 32*d* becomes constant, similarly to the expansion device 25*a* and the expansion device 25*b* discussed above.

(Heating Only Operation Mode)

FIG. 11 is a refrigerant circuit diagram illustrating the flow of refrigerant during a heating only operation mode of the air-conditioning apparatus 200. The heating only operation mode will be described with reference to FIG. 11, taking as an example the case where a heating load is generated by only the use side heat exchanger 26*a* and the use side heat exchanger 26*b*. Note that in FIG. 11, pipes indicated in bold represent pipes through which the refrigerant flows, while solid-line arrows represent the direction in which the refrigerant flows.

In the case of the heating only operation mode illustrated in FIG. 11, in the outdoor unit 1, the refrigerant flow switching device 11 switches such that heat source side refrigerant discharged from the compressor 10 flows into the relay unit 3 without passing through the heat source side heat exchanger 12. The low temperature and low pressure refrigerant is compressed by the compressor 10 to become the high temperature and high pressure gas refrigerant, and is discharged. The high temperature and high pressure gas refrigerant discharged from the compressor 10 passes through the first check valve 13*b*, and flows out of the outdoor unit 1. The high temperature and high pressure gas refrigerant flowing out of the outdoor unit 1 flows into the relay unit 3 via the main pipe 4 on the high pressure refrigerant side. The high temperature and high pressure gas refrigerant flowing into the relay unit 3 passes through the first shutoff device 42, the gas liquid separator 14, the first opening and closing devices 23, the fourth shutoff devices 38, and the branch pipes 5, and then respectively flows into the use side heat exchanger 26*a* and the use side heat exchanger 26*b*, and becomes the liquid refrigerant while heating the indoor space by transferring heat to the indoor air. The liquid refrigerant flowing out of the use side heat exchanger 26*a* and the use side heat exchanger 26*b* is expanded by the first expansion devices 25, passes through the branch pipes 5, the third shutoff devices 37, the third check valves 22, the third expansion device 27, the second shutoff device 43, and the main pipe 4 on the low pressure refrigerant side, and once again flows into the outdoor unit 1. The refrigerant flowing into the outdoor unit 1 passes through the first check valve 13*c* and becomes the low temperature and low pressure gas refrigerant while taking away heat from outside air at the heat source side heat exchanger 12, and is once again suctioned into the compressor 10 via the refrigerant flow switching device 11 and the accumulator 19.

At this point, the opening degree of the expansion device 25*a* is controlled such that the subcooling (degree of cooling) obtained as the difference between the temperature detected by the first temperature sensor 31*a* and a value obtained by converting the pressure detected by the first pressure sensor 33 into a saturation temperature becomes constant. Similarly, the opening degree of the expansion device 25*b* is controlled such that the subcooling (degree of cooling) obtained as the difference between the temperature detected by the first temperature sensor 31*b* and a value obtained by converting the pressure detected by the first pressure sensor 33 into a saturation temperature becomes constant.

Meanwhile, for the use side heat exchanger 26*c* and the use side heat exchanger 26*d* without a heating load, there is no need to circulate the refrigerant, and the respectively corresponding expansion device 25*c* and expansion device 25*d* are closed. Furthermore, in the case where a heating load is generated from the use side heat exchanger 26*c* or the use side heat exchanger 26*d*, the expansion device 25*c* or the expansion device 25*d* may be opened to allow the circulation of refrigerant. The opening degree of the expansion device 25*c* or the expansion device 25*d* is controlled such that the subcooling (degree of subcooling) obtained as the difference between the temperature detected by the first temperature sensor 31*c* or 31*d* and a value obtained by converting the pressure detected by the pressure sensor 33 into a saturation temperature becomes constant, similarly to the expansion device 25*a* and the expansion device 25*b* discussed above.

(Cooling Main Operation Mode)

Figure 12:
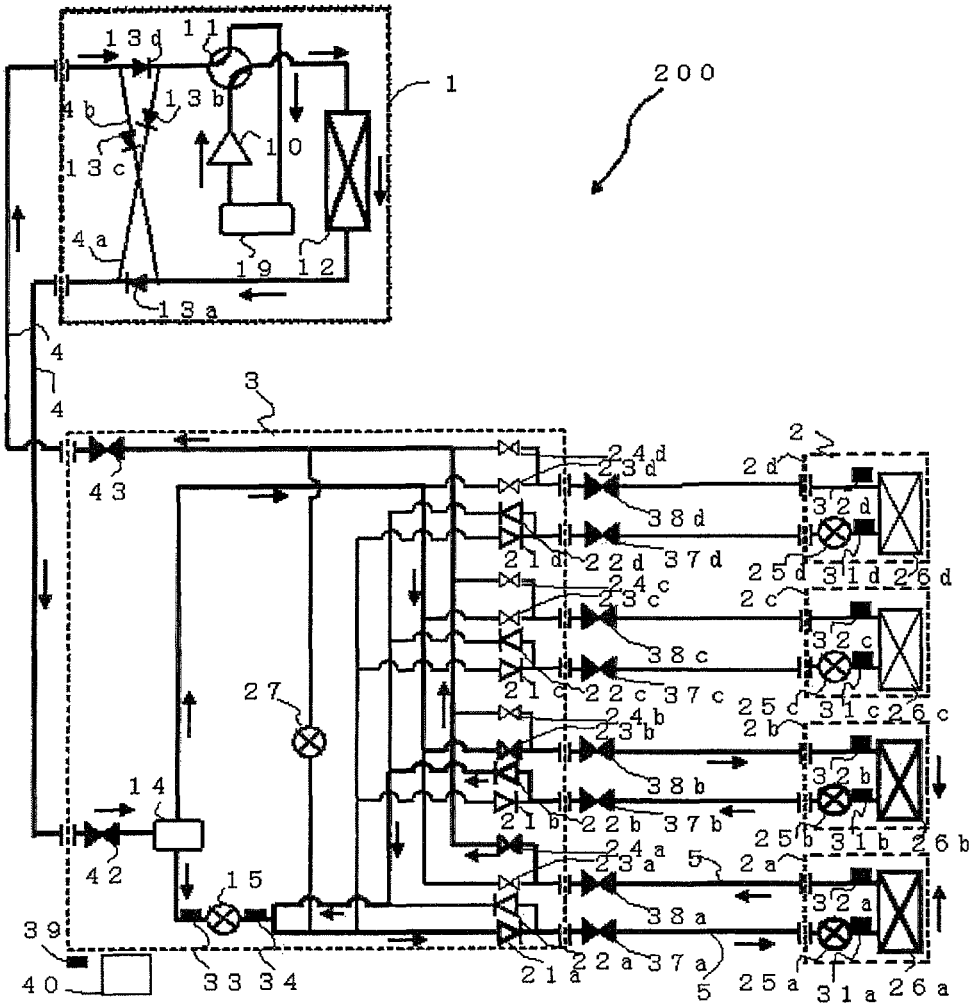
FIG. 12 is a refrigerant circuit diagram illustrating the flow of refrigerant during a cooling main operation mode of the air-conditioning apparatus according to Embodiment 2 of the present invention.

FIG. 12 is a refrigerant circuit diagram illustrating the flow of refrigerant during a cooling main operation mode of the air-conditioning apparatus 200. The cooling main operation mode will be described with reference to FIG. 12, taking as an example the case where a cooling load is generated by the use side heat exchanger 26*a*, and a heating load is generated by the use side heat exchanger 26*b*. Note that in FIG. 12, pipes indicated in bold represent pipes through which the refrigerant flows, while solid-line arrows represent the direction in which the refrigerant flows.

In the case of the cooling main operation mode illustrated in FIG. 12, in the outdoor unit 1, the refrigerant flow switching device 11 switches such that heat source side refrigerant discharged from the compressor 10 flows into the heat source side heat exchanger 12. The low temperature and low pressure refrigerant is compressed by the compressor 10 to become the high temperature and high pressure gas refrigerant, and is discharged. The high temperature and high pressure gas refrigerant discharged from the compressor 10 flows into the heat source side heat exchanger 12 via the refrigerant flow switching device 11. The refrigerant then becomes the two-phase refrigerant while transferring heat to the outside air in the heat source side heat exchanger 12. The refrigerant flowing out of the heat source side heat exchanger 12 flows into the relay unit 3 via the first check valve 13*a* and the main pipe 4 on the high pressure refrigerant side. The two-phase refrigerant flowing into the relay unit 3 is separated into the high pressure gas refrigerant and the high pressure liquid refrigerant at the gas liquid separator 14. The high pressure gas refrigerant passes through the first opening and closing device 23*b*, the fourth shutoff device 38*b*, and a branch pipe 5, and then flows into the use side heat exchanger 26*b* serving as a condenser, becoming the liquid refrigerant while heating the indoor space by transferring heat to the indoor air. Meanwhile, the liquid refrigerant flowing out of the use side heat exchanger 26*b* is expanded by the first expansion device 25*b*, and passes through the a branch pipe 5, the third shutoff device 37*b*, and the third check valve 22*b*. The liquid refrigerant passing through the third check valve 22*b* is separated at the gas liquid separator 14, and then converges with the intermediate pressure liquid refrigerant that has been expanded to an intermediate pressure (approximately 0.3 MPa less than the high pressure, for example) at the second expansion device. The converged liquid refrigerant passes through the second check valve 21*a*, the third shutoff device 37*a*, and a branch pipe 5, and then is expanded by the first expansion device 25*a* to become the low temperature and low pressure two-phase refrigerant. The two-phase refrigerant flows into the use side heat exchanger 26*a* serving as an evaporator, and becomes the low temperature and low pressure gas refrigerant while cooling indoor air by taking away heat from the indoor air. The gas refrigerant flowing out of the use side heat exchanger 26*a* passes through a branch pipe 5, the fourth shutoff device 38*a*, the second opening and closing device 24*a*, and the second shutoff device 43, flows out of the relay unit 3, and once again flows into the outdoor unit 1 via the main pipe 4 on the low pressure refrigerant side. The refrigerant flowing into the outdoor unit 1 passes through the first check valve 13*d* and is once again suctioned into the compressor 10 via the refrigerant flow switching device 11 and the accumulator 19.

At this point, the opening degree of the first expansion device 25*b* is controlled such that the subcooling (degree of cooling) obtained as the difference between the temperature detected by the first temperature sensor 31*b* and a value obtained by converting the pressure detected by the first pressure sensor 33 into a saturation temperature becomes constant. Meanwhile, the opening degree of the first expansion device 25*a* is controlled such that the superheat (degree of superheat) obtained as the difference between the temperature detected by the first temperature sensor 31*a* and the temperature detected by the second temperature sensor 32*b* becomes constant.

In addition, the opening degree of the second expansion device 15 is controlled such that pressure differential between the pressure detected by the first pressure sensor 33 and the pressure detected by the second pressure sensor 34 becomes a predetermined pressure differential (such that the reading of the first pressure sensor 33 minus the reading of the second pressure sensor 34 is approximately 0.3 MPa, for example).

At this point, for the use side heat exchanger 26*c* and the use side heat exchanger 26*d* without a heating load, there is no need to circulate the refrigerant, and the respectively corresponding expansion device 25*c* and expansion device 25*d* are closed. Furthermore, in the case where a heating load is generated from the use side heat exchanger 26*c* or the use side heat exchanger 26*d*, the expansion device 25*c* or the expansion device 25*d* may be opened to allow the circulation of refrigerant.

(Heating Main Operation Mode)

Figure 13:
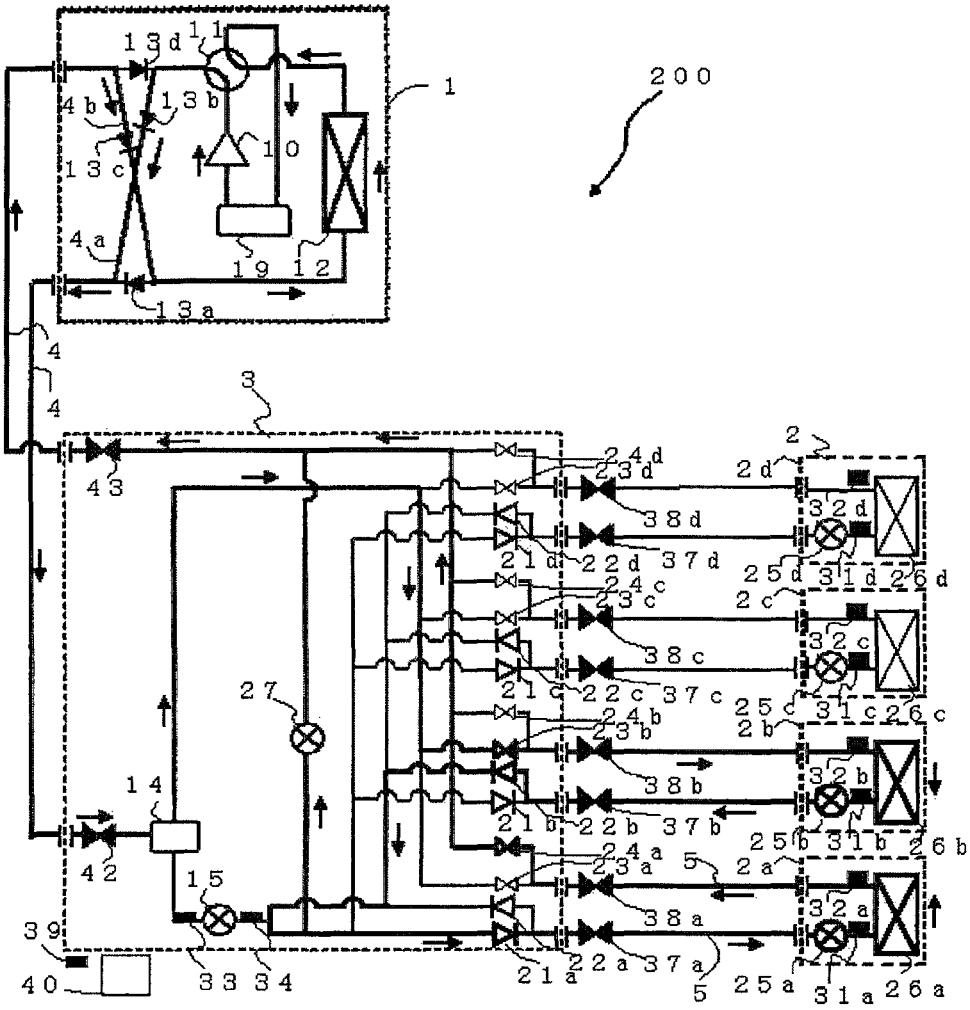
FIG. 13 is a refrigerant circuit diagram illustrating the flow of refrigerant during a heating main operation mode of the air-conditioning apparatus according to Embodiment 2 of the present invention.

FIG. 13 is a refrigerant circuit diagram illustrating the flow of refrigerant during a heating main operation mode of the air-conditioning apparatus 200. The heating main operation mode will be described with reference to FIG. 13, taking as an example the case where a cooling load is generated by the use side heat exchanger 26*a*, and a heating load is generated by the use side heat exchanger 26*b*. Note that in FIG. 13, pipes indicated in bold represent pipes through which the refrigerant flows, while solid-line arrows represent the direction in which the refrigerant flows.

In the case of the heating main operation mode illustrated in FIG. 13, in the outdoor unit 1, the refrigerant flow switching device 11 switches such that heat source side refrigerant discharged from the compressor 10 flows into the relay unit 3 without passing through the heat source side heat exchanger 12. The low temperature and low pressure refrigerant is compressed by the compressor 10 to become the high temperature and high pressure gas refrigerant, and is discharged. The high temperature and high pressure gas refrigerant discharged from the compressor 10 passes through the first check valve 13*b*, and flows out of the outdoor unit 1. The high temperature and high pressure gas refrigerant flowing out of the outdoor unit 1 flows into the relay unit 3 via the main pipe 4 on the high pressure refrigerant side. The high temperature and high pressure gas refrigerant flowing into the relay unit 3 passes through the first shutoff device 42, the gas liquid separator 14, the first opening and closing device 23*b*, the fourth shutoff device 38*b*, and a branch pipe 5, and then flows into the use side heat exchanger 26*b* serving as a condenser, and becomes the liquid refrigerant while heating the indoor space by transferring heat to the indoor air. The liquid refrigerant flowing out of the use side heat exchanger 26*b* is expanded by the first expansion device 25*b*, passes through the a branch pipe 5, the third shutoff device 37*b*, and the third check valve 22*b*, and is branched by the second check valve 21*a* and the third expansion device 27 which is used as a bypass. The liquid refrigerant flowing into the second check valve 21*a* passes through the third shutoff device 37*a*, and a branch pipe 5, and then is expanded by the first expansion device 25*a* to become the low temperature and low pressure two-phase refrigerant. The two-phase refrigerant flows into the use side heat exchanger 26*a* serving as an evaporator, and becomes the low temperature and low pressure gas refrigerant while cooling indoor air by taking away heat from the indoor air. The gas refrigerant flowing out of the use side heat exchanger 26*a* passes through a branch pipe 5, the fourth shutoff device 38*a*, and the second opening and closing device 24*a*, converges with the bypassed liquid refrigerant from the outlet of the third expansion device 27, passes through the second shutoff device 43, flows out of the relay unit 3, and once again flows into the outdoor unit 1 via the main pipe 4 on the low pressure refrigerant side. The refrigerant flowing into the outdoor unit 1 passes through the first check valve 13*c* and becomes the low temperature and low pressure gas refrigerant while taking away heat from outside air at the heat source side heat exchanger 12, and is once again suctioned into the compressor 10 via the refrigerant flow switching device 11 and the accumulator 19.

At this point, the opening degree of the first expansion device 25*b* is controlled such that the subcooling (degree of cooling) obtained as the difference between the temperature detected by the first temperature sensor 31*b* and a value obtained by converting the pressure detected by the first pressure sensor 33 into a saturation temperature becomes constant. Meanwhile, the opening degree of the first expansion device 25*a* is controlled such that the superheat (degree of superheat) obtained as the difference between the temperature detected by the first temperature sensor 31*a* and the temperature detected by the second temperature sensor 32*b* becomes constant.

In addition, the opening degree of the third expansion device 27 is controlled such that pressure differential between the pressure detected by the first pressure sensor 33 and the pressure detected by the second pressure sensor 34 becomes a predetermined pressure differential (such that the reading of the first pressure sensor 33 minus the reading of the second pressure sensor 34 is approximately 0.3 MPa, for example).

At this point, for the use side heat exchanger 26*c* and the use side heat exchanger 26*d* without a heating load, there is no need to circulate the refrigerant, and the respectively corresponding expansion device 25*c* and expansion device 25*d* are closed. Furthermore, in the case where a heating load is generated from the use side heat exchanger 26*c* or the use side heat exchanger 26*d*, the expansion device 25*c* or the expansion device 25*d* may be opened to allow the circulation of refrigerant.

For example, assume that the refrigerant quantity in the outdoor unit 1 is 8.0 kg for an outdoor unit capacity from 5 hp to 8 hp, 10.5 kg from 9 hp to 14 hp, 11.5 kg from 15 hp to 18 hp, 13.0 kg from 19 hp to 20 hp, 18.0 kg from 21 hp to 28 hp, and 20.0 kg or more for 29 hp or more. Assume that the refrigerant quantity in an indoor unit 2 is 3.0 kg for 10 hp or less, 5.0 kg for 10 hp to 25 hp, 9.0 kg for 25 hp to 35 hp, and 14.0 kg for 36 hp or more. Additionally, for the refrigerant quantity in the relay unit 3, assume that the outdoor unit capacity is 3.0 kg for 12 hp or less, 5.0 kg for 13 hp to 18 hp, 9.5 kg for 19 hp to 28 hp, and 13.0 kg for 29 hp or more.

The allowable refrigerant leakage quantity will now be described for the case where the refrigerant leaks into the non-air-conditioned space 8 and also spreads to the indoor space 7 due to brazing failure or the like in the relay unit 3.

Assume that M1 (kg) is the refrigerant quantity of the outdoor unit 1 corresponding to the capacity of the outdoor unit 1, that M2 (kg) is the refrigerant quantity of the indoor units 2 corresponding to the total capacity of the indoor units 2, that M3 is the refrigerant quantity of the relay unit 3 corresponding to the outdoor unit capacity, and that n is the number of indoor units 2 (number of branches). Also assume that D1 (m) is the diameter of the main pipe 4 on the high pressure side, that D2 (m) is the diameter of the branch pipe 5 on the liquid side, that L1 (m) is the length of the main pipes 4 (the distance between the outdoor unit 1 and the inlet of the relay unit 3), and that L2 (m) is the average length of the branch pipes 5 (the distance of the branch pipes 5 from the outlet of the relay unit 3 to the inlets of the indoor units 2). Furthermore, assume that V2 ($m^3$) is the volume of the indoor space 7, and that $\rho \approx 981$ kg/$m^3$ is the refrigerant liquid density (for example, the liquid density for the case of R32 refrigerant with an outside average temperature of 20 degrees C.; the value differs depending on the refrigerant used). Assuming the above provides Eqs. 3-1 to 3-3 (all units in kilograms). Then, if attempting to construct an air-conditioning apparatus that satisfies Eq. 3-1, the first shutoff device 42 and the second shutoff device 43 are required. Also, if attempting to construct an air-conditioning apparatus that satisfies Eq. 3-2, installation of the third shutoff devices 37 and the fourth shutoff devices 38 is required. Also, if attempting to construct an air-conditioning apparatus that satisfies Eq. 3-3, installation of the first shutoff device 42, the second shutoff device 43, the third shutoff devices 37 and the fourth shutoff devices 38 is required. Note that in the case of providing the first shutoff device 42 and the second shutoff device 43 on the main pipes 4, although the refrigerant leakage from the outdoor unit 1 can be suppressed by the first check valves 13 in the outdoor unit 1 during a refrigerant leak, the leak rate of the first check valves 13 is approximately $1.0\times10^{-5}$ for a pressure differential of 1.5 MPa, greater than the leak rate of the second shutoff device 43 which is $1.0\times10^{-6}$ or less for a pressure differential of 5.0 MPa. Furthermore, in the heating only operation mode, the refrigerant accumulates in the main pipes 4 between the second shutoff device 43 and the outdoor unit 1, thus necessitating the second shutoff device 43 in order to reliably prevent refrigerant leakage from the outdoor unit 1 and the main pipes 4.

$$M1+(D1/2)^2\times\pi\times\rho\times L1<0.8\times V2 \quad (3\text{-}1)$$

$$M2+M3+(D2/2)^2\times\pi\times\rho\times L2<0.8\times V2 \quad (3\text{-}2)$$

$$(\text{left-hand side of Eq. 3-1})+(\text{left-hand side of Eq. 3-2})<0.8\times V2 \quad (3\text{-}3)$$

For example, in the case where the outdoor unit capacity is 16 hp, n=8, D1=20.22 (outer diameter 22.22, wall thickness 1.0) mm, L1=50.0 m, D2=7.92 (outer diameter 9.52, wall thickness 0.8) mm, and V2=25.0 $m^3$, the limit of the refrigerant charged quantity of 20.0 kg is obtained according to the right-hand sides of Eqs. 3-1 to 3-3. Calculating L2 on the left-hand side of Eq. 3-2 so as to satisfy Eq. 3-2 provides L2<25.8 m. Using this L2 to calculate the total refrigerant quantity in the relay unit 3, the branch pipes 5, and the indoor units 2 provides approximately 19.98 kg<20.0 kg according to the left-hand side of Eq. 3-2. Also, the total refrigerant quantity of the main pipes 4 and the outdoor unit 1 of approximately 27.23 kg>20.0 kg is obtained according to the left-hand side of Eq. 3-1. For this reason, the total refrigerant quantity of the air-conditioning apparatus of 47.21 kg>20.0 kg is obtained according to the left-hand side of Eq. 3-3. Since the total refrigerant quantity in the main pipes 4 and the outdoor unit 1 is 27.23 kg>20.0 kg, the shutoff devices on the side of the outdoor unit 1 and the main pipes 4, that is, the first shutoff device 42 and the second shutoff device 43, are required. Meanwhile, if L2>25.8 m, the total refrigerant quantity of the relay unit 3, the branch pipes 5, and the indoor units 2 of approximately 20.02 kg>20.0 kg is obtained according to the left-hand side of Eq. 3-2, and thus the installation of shutoff devices on the side of the branch pipes 5 and the indoor units 2, that is, the third shutoff devices 37 and the fourth shutoff devices 38, are required.

Additionally, assume that the outdoor unit capacity is 16 hp, n=8, D1=20.22 (outer diameter 22.22, wall thickness 1.0) mm, L2=30.0 m, D2=7.92 (outer diameter 9.52, wall thickness 0.8) mm, and V2=25.0 $m^3$. The limit of the refrigerant charged quantity of 20.0 kg is obtained according to the right-hand sides of Eqs. 3-1 to 3-3. Calculating L1 on the left-hand side of Eq. 3-1 so as to satisfy Eq. 3-1 provides L1<27.0 m. Using this L1 to calculate the total refrigerant quantity in the main pipes 4 and the outdoor unit 1 provides approximately 19.992 kg<20.0 kg according to the left-hand side of Eq. 3-1. Also, the total refrigerant quantity of the relay unit 3, the branch pipes 5, and the indoor units 2 of approximately 21.61 kg>20.0 kg is obtained according to Eq. 3-2. For this reason, the total refrigerant quantity of the air-conditioning apparatus of 41.602 kg>20.0 kg is obtained according to Eq. 3-3. Since the total refrigerant quantity in the relay unit 3, the branch pipes 5 and the indoor units 2 is approximately 21.61 kg>20.0 kg according to the left-hand side of Eq. 3-2, the installation of the third shutoff devices 37 and the fourth shutoff devices 38 on the branch pipes 5 is required. Meanwhile, if L1>27.1 m, the total refrigerant quantity of the main pipes 4 and the outdoor unit 1 of approximately 20.03 kg>20.0 kg is obtained according to the left-hand side of Eq. 3-1, and thus the installation of shutoff devices on the side of the main pipes 4 and the outdoor unit 1, that is, the first shutoff device 42 and the second shutoff device 43, is required.

Also, in the case where the outdoor unit capacity is 16 hp, n=8, D1=20.22 (outer diameter 22.22, wall thickness 1.0) mm, L1=25.0 m, L2=15.0 m, D2=7.92 (outer diameter 9.52, wall thickness 0.8) mm, and V2=25.0 $m^3$, the limit of the refrigerant charged quantity of 20.0 kg is obtained according to the right-hand sides of Eqs. 3-1 to 3-3. The total refrigerant quantity in the main pipes 4 and the outdoor unit 1 is approximately 19.37 kg<20.0 kg according to the left-hand side of Eq. 3-1, while the total refrigerant quantity in the relay unit 3, the branch pipes 5, and the indoor units 2 is approximately 15.81 kg<20.0 kg according to Eq. 3-2. At this point, since the total refrigerant quantity in the air-conditioning apparatus is 35.18 kg>20.0 kg according to Eq. 3-3, it is necessary to install either the first shutoff device 42 and the second shutoff device 43, or the third shutoff devices 37 and the fourth shutoff devices 38. Additionally, all of the first shutoff device 42, the second shutoff device 43, the third shutoff devices 37, and the fourth shutoff devices 38 may also be installed in the above example in order to further raise safety with respect to the refrigerant leakage quantity.

At this point, in the case where a fifth shutoff device and a sixth shutoff device, for example, are installed at positions in the vicinity of the indoor units 2, for example, the total refrigerant quantity in the branch pipes 5 and the relay unit 3 may be calculated by setting M2 to 0 kg in Eq. 3-2. Also, the constant 0.8 on the right-hand sides of Eqs. 3-1 to 3-3 is the charged refrigerant quantity limit. At this point, R32 is 0.800 kg/$m^3$, and HFO-1234yf is approximately 0.759 kg/m$^3$. Also, an R32/HFO mixture is approximately 0.777 kg/m$^3$ in the case where the composition ratios of R32/HFO-1234yf are 44% for R32 and 56% for HFO-1234yf, for example. Additionally, the charged refrigerant quantity limit is 0.790 kg/m$^3$ in the case where R32 is 73% and HFO-1234yf is 27%. Also, propane is approximately 0.105 kg/m$^3$.

Next, the installation positions of the first shutoff device 42 and the second shutoff device 43 as well as the installation positions of the third shutoff devices 37 and the fourth shutoff devices 38 will be described. Assuming that L3 (m) is the installation length of the first shutoff device 42 and the second shutoff device 43 (the distance from the shutoff devices to the inlet of the relay unit 3) and that L4 (m) is the installation length of the third shutoff devices 37 and the fourth shutoff devices 38 (the distance from the shutoff devices to the inlet of the relay unit 3) provides Eqs. 4-1 to 4-3 (all units in kg).

Then, in the case of attempting to install the first shutoff device 42 and the second shutoff device 43, the first shutoff device 42 and the second shutoff device 43 are installed within an L3 (m) that satisfies Eq. 4-1.

$$\{(D1/2)^2\times\pi\times\rho\times L3\}+\{M2+M3+(D2/2)^2\times n\times\pi\times\rho\times L2\}<0.8\times V2 \quad (4\text{-}1)$$

For example, assume that the outdoor unit capacity is 16 hp, n=8, D1=20.22 (outer diameter 22.22, wall thickness 1.0) mm, L2=20.0 m, D2=7.92 (outer diameter 9.52, wall thickness 0.8) mm, and V2=25.0 m$^3$. Then, in the case of attempting to install the first shutoff device 42 and the second shutoff device 43 on the main pipes 4, the limit of the refrigerant charged quantity of 20.0 kg is obtained according to the right-hand side of Eq. 4-1, and calculating L3 on the left-hand side of Eq. 4-1 so as to satisfy Eq. 4-1 provides L3<7.1 m. For this reason, it is necessary to install the first shutoff device 42 and the second shutoff device 43 such that the distance L3 from the first shutoff device 42 and the second shutoff device 43 to the inlet of the relay unit 3 is less than 7.1 m.

Also, in the case of attempting to install only the third shutoff devices 37 and the fourth shutoff devices 38, the third shutoff devices 37 and the fourth shutoff devices 38 are installed within an L4 (m) that satisfies Eq. 4-2.

$$\{(D1/2)^2\times\pi\times\rho\times L1+M1\}+M3+\{(D2/2)^2\times n\times\pi\times\rho\times L4\}<0.8\times V2 \quad (4\text{-}2)$$

For example, assume that the outdoor unit capacity is 16 hp, n=8, D1=20.22 (outer diameter 22.22, wall thickness 1.0) mm, L1=10.0 m, D2=7.92 (outer diameter 9.52, wall thickness 0.8) mm, and V2=25.0 m$^3$. Then, in the case of attempting to install the third shutoff devices 37 and the fourth shutoff devices 38 on the branch pipes 5, the limit of the refrigerant charged quantity of 20.0 kg is obtained according to the right-hand side of Eq. 4-2, and calculating L4 on the left-hand side of Eq. 4-2 so as to satisfy Eq. 4-2 provides L4<0.9 m. For this reason, it is necessary to install the third shutoff devices 37 and the fourth shutoff devices 38 such that the distance L4 from the third shutoff devices 37 and the fourth shutoff devices 38 to the inlet of the relay unit 3 is less than 0.9 m.

Also, in the case of attempting to install all of the first shutoff device 42, the second shutoff device 43, the third shutoff devices 37, and the fourth shutoff devices 38, the first shutoff device 42 and the second shutoff device 43 are installed within an L3 (m), and the third shutoff devices 37 and the fourth shutoff devices 38 are installed within an L4 (m), that satisfy Eq. 4-3.

$$(D1/2)^2\times\pi\times\rho\times L3+(D2/2)^2\times n\times\pi\times\rho\times L4<0.8\times V2 \quad (4\text{-}3)$$

For example, assume that the outdoor unit capacity is 16 hp, n=8, D1=20.22 (outer diameter 22.22, wall thickness 1.0) mm, L1=50.0 m, L2=30.0 m, D2=7.92 (outer diameter 9.52, wall thickness 0.8) mm, and V2=25.0 m$^3$. The limit of the refrigerant charged quantity of 20.0 kg is then obtained according to the right-hand side of Eq. 4-3, and the refrigerant quantity inside the indoor units 2, the relay unit 3, and the branch pipes 5 of approximately 21.61 kg>20.0 kg is obtained according to the second term enclosed in { } on the left-hand side of Eq. 4-1. Also, the refrigerant quantity inside the outdoor unit 1 and the main pipes 4 of approximately 27.23 kg>20.0 kg is obtained according to the first term enclosed in { } on the left-hand side of Eq. 4-2. The first shutoff device 42 and the second shutoff device 43 are required on the main pipes 4, while the third shutoff devices 37 and the fourth shutoff devices 38 are required on the branch pipes.

At this point, if the first shutoff device 42 and the second shutoff device 43 are installed on the main pipes 4 with L3<29.2 m, and if the third shutoff devices 37 and the fourth shutoff devices 38 are installed on the branch pipes 5 with L4<15.0 m, then according to the left-hand side of Eq. 4-3, the refrigerant quantity inside the pipes respectively connected to each shutoff device, and the refrigerant quantity inside the pipes connected to the relay unit 3 and inside the relay unit 3, will become approximately 19.99 kg<20.0 kg. Consequently, the first shutoff device 42 and the second shutoff device 43 may be installed on the main pipes 4 with L3<29.2 m, and the third shutoff devices 37 and the fourth shutoff devices 38 may be installed on the branch pipes 5 with L4<15.0 m. Also, since each shutoff device is installed in the non-air-conditioned space 8, in the case where the computed distance of L3 extends out of the non-air-conditioned space 8 and enters the outdoor space 6, the first shutoff device 42 and the second shutoff device 43 installed on the main pipes 4 may be installed at installation positions between the main pipes 4 immediately entering the non-air-conditioned space 8 from the outdoor space 6, and the relay unit 3.

At this point, in the case where a fifth shutoff device and a sixth shutoff device, for example, are installed at positions in the vicinity of the indoor units 2, for example, the distance L3 may be calculated by setting M2 to 0 kg in Eq. 4-1. Also, the constant 0.8 on the right-hand sides of Eqs. 4-1 to 4-3 is the charged refrigerant quantity limit. At this point, R32 is 0.800 kg/m$^3$, and HFO-1234yf is approximately 0.759 kg/m$^3$. Also, an R32/HFO mixture is approximately 0.777 kg/m$^3$ in the case where the composition ratios of R32/HFO-1234yf are 44% for R32 and 56% for HFO-1234yf, for example. Additionally, the charged refrigerant quantity limit is 0.790 kg/m$^3$ in the case where R32 is 73% and HFO-1234yf is 27%. Also, propane is approximately 0.105 kg/m$^3$.

By installing the first shutoff device 42, the second shutoff device 43, the third shutoff devices 37, and the fourth shutoff devices 38 at positions determined on the basis of calculations like the above, when the refrigerant leaks into the non-air-conditioned space 8 from the outdoor unit 1, the main pipes 4, the branch pipes 5, or the indoor units 2, the refrigerant leakage quantity that spreads to the indoor space 7 may be suppressed to less than or equal to a limit value for the refrigerant leakage quantity allowable by the indoor space 7 (the refrigerant charged quantity limit or less).

As above, according to an air-conditioning apparatus of Embodiment 2, and similarly to Embodiment 1, for a refrigerant leak from a refrigerant circuit, if the shutoff valve control device 40 determines that refrigerant has leaked on the basis of a refrigerant concentration detected by the concentration detecting device 39 in a non-air-conditioned space 8 such as above the ceiling, for example, the first shutoff device 42, the second shutoff device 43, the third shutoff devices 37, and the fourth shutoff devices 38 are made to shut off the flow of refrigerant, thereby minimizing refrigerant leakage in the non-air-conditioned space 8, preventing the spread of refrigerant to the air-conditioned space, and not only greatly improving safety, but also reducing the environmental load.

Also, since the pipes on which to install shutoff devices are determined on the basis of the refrigerant quantity in the outdoor unit 1, the main pipes 4, the relay unit 3, the indoor units 2, and the branch pipes 5, and the volume of the indoor space 7, it is possible to efficiently install shutoff devices while taking into account the effects of refrigerant leakage from the non-air-conditioned space 8 into the indoor space 7. Also, since the distances from the relay unit 3 to the main pipes 4 and the branch pipes 5 are determined on the basis of refrigerant quantity therebetween, the volume of the indoor space 7, and the refrigerant charged quantity limit value, it is possible to install shutoff devices at positions that take into account the effects of refrigerant leakage from the non-air-conditioned space 8 into the indoor space 7.

Herein, as the refrigerant of Embodiment 1 and Embodiment 2, a refrigerant with low global warming potential (such as HFO-1234yf, R32, or HC, for example), or alternatively, a flammable global warming potential (such as HFO-1234yf, HFO-1234ze, R32, a refrigerant mixture containing R32 and HFO-1234yf, a refrigerant mixture containing at least one of the above refrigerants as a component, and HC, for example) may be used as the refrigerant in a multi-air-conditioning system for a building.

In an air-conditioning apparatus 100 and an air-conditioning apparatus 200 employing a configuration as described in the foregoing, detecting refrigerant leakage from a refrigerant circuit becomes possible. The enclosed charged refrigerant quantity set as a limit for the refrigerant circuit is equal to or greater than 0.800 kg/m$^3$ for R32, approximately 0.759 kg/m$^3$ for HFO-1234yf, approximately 0.777 kg/m$^3$ for an R32/HFO mixture the case where the composition ratios of R32/HFO-1234yf are 44% for R32 and 56% for HFO-1234yf and approximately 0.790 kg/m$^3$ in the case of R32 is 73% and HFO-1234yf is 27%, for example, and approximately 0.105 kg/m$^3$ for propane. There are provided shutoff devices for reducing the leakage quantity in the case where the refrigerant leaks into the non-air-conditioned space 8, thereby greatly improving safety by preventing the refrigerant from leaking into the non-air-conditioned space 8 and the indoor space 7.

The invention claimed is:

1. An air-conditioning apparatus comprising:

an outdoor unit configured to include a compressor and a heat source side heat exchanger;

a plurality of indoor units configured to include load-side expansion valves and load-side heat exchangers and configured to air-condition an air-conditioned space;

branching pipes, connected to the outdoor unit by a plurality of main pipes and connected to each indoor unit by a plurality of branch pipes, configured to branch a refrigerant from a side of the main pipes and circulate the refrigerant to the branch pipes, and converge the refrigerant from a side of the branch pipes and circulate the refrigerant to the main pipes;

a refrigerant concentration detecting device installed in a non-air-conditioned space, which is a different space from the air-conditioned space, and which is in a relative position where the refrigerant potentially spread into the air-conditioned space if the refrigerant leaks;

shutoff valves configured to shut off either or both flows between the outdoor unit and the branching pipes on the side of the main pipes and flows between the indoor units and the branching pipes on the side of the branch pipes; and a controller configured, upon determining that the refrigerant has leaked on a basis of a detection by the refrigerant concentration detecting device, to control the shutoff valves to shut off the refrigerant flows; wherein the branching pipes are installed in the non-air-conditioned space, and provided that a refrigerant quantity inside the main pipes is a main-pipe enclosed refrigerant quantity W1 (kg), a refrigerant quantity inside the branch pipes is a branch-pipe enclosed refrigerant quantity W2 (kg), a refrigerant quantity inside the outdoor unit is M1 (kg), and a refrigerant quantity inside the indoor units is M2 (kg), one of either a value (W1+M1)/V obtained by dividing a sum of the main-pipe enclosed refrigerant quantity W1 and the refrigerant quantity M1 inside the outdoor unit by a volume V (m$^3$) of the air-conditioned space or a value (W2+M2)/V obtained by dividing a sum of the branch-pipe enclosed refrigerant quantity W2 and the refrigerant quantity M2 inside the indoor units by the volume V (m$^3$) of the air-conditioned space is equal to or greater than a predetermined refrigerant charged quantity limit value B (kg/m$^3$) determined on a basis of a flammability risk of the refrigerant, wherein the shutoff valves shut off pipes on a side equal to or greater than the predetermined refrigerant charged quantity limit value B (kg/m$^3$).

2. The air-conditioning apparatus of claim 1, wherein when the value (W1+M1)/V and the value (W2+M2)/V do not satisfy the predetermined refrigerant charged quantity limit value B (kg/m$^3$), and a sum of the value (W1+M1)/V and the value (W2+M2)/V is equal to or greater than the predetermined refrigerant charged quantity limit value B (kg/m$^3$), the shutoff valves are provided on either the side of the main pipes or the side of the branch pipes.

3. The air-conditioning apparatus of claim 1, wherein the shutoff valves are further provided at a position in the vicinity of the indoor units, and the refrigerant quantity M2 inside the indoor units is set to 0 kg.

4. The air-conditioning apparatus of claim 1, wherein a length of the main pipes between the shutoff valves on the side of the main pipes and the branching pipes is set such that a value W3/V obtained by dividing a refrigerant quantity W3 (kg) in the main pipes between the shutoff valves on the side of the main pipes and the branching pipes by the volume V (m$^3$) of the air-conditioned space is less than or equal to the predetermined refrigerant charged quantity limit value B (kg/m$^3$), and a length of the branch pipes between the shutoff valves on the side of the branch pipes and the branching pipes is set such that a value W4/V obtained by dividing a refrigerant quantity W4 (kg) in the branch pipes between the shutoff valves on the side of the branch pipes and the branching pipes by the volume V (m$^3$) of the air-conditioned space is less than or equal to the predetermined refrigerant charged quantity limit value B (kg/m$^3$).

5. The air-conditioning apparatus of claim 1, wherein a length of the main pipes between the shutoff valves on the side of the main pipes and the branching pipes is set such that a value (W3+W2+M2)/V obtained by dividing a sum of a refrigerant quantity W3 (kg) in the main pipes between the shutoff valves on the side of the main pipes and the branching pipes, a branch pipe enclosed refrigerant quantity W2 (kg), and a refrigerant quantity M2 (kg) inside the indoor units by the volume V (m$^3$) of the air-conditioned space is less than or equal to the predetermined refrigerant charged quantity limit value B (kg/m$^3$).

6. The air-conditioning apparatus of claim 1, wherein a length of the branch pipes between the shutoff valves on the side of the branch pipes and the branching pipes is set such that a value (W4+W1+M1)/V obtained by dividing a sum of a refrigerant quantity W4 (kg) in the branch pipes between the shutoff valves on the side of the branch pipes and the branching pipes, a main-pipe enclosed refrigerant quantity W1 (kg), and the refrigerant quantity M1 (kg) inside the outdoor unit by the volume V (m$^3$) of the air-conditioned space is less than or equal to the predetermined refrigerant charged quantity limit value B (kg/m$^3$).

7. The air-conditioning apparatus of claim 1, wherein the refrigerant is a refrigerant with flammable properties.

8. The air-conditioning apparatus of claim 7, wherein the refrigerant is HFO-1234yf, HFO-1234ze, R32, a refrigerant mixture containing R32 and HFO-1234yf, a refrigerant mixture containing at least one of HFO-1234yf, HFO-1234ze, or R32 as a component, or HC.

9. The air-conditioning apparatus of claim 8, wherein the refrigerant charged quantity limit value B is 0.800 kg/m$^3$ or less for R32, 0.759 kg/m$^3$ or less for HFO-1234yf, 0.777 kg/m$^3$ or less for a refrigerant mixture with a composition ratio of 44% for R32 and 56% for HFO-1234yf, 0.790 kg/m$^3$ or less for a refrigerant mixture with a composition ratio of 73% for R32 and 27% for HFO-1234yf, and 0.105 kg/m$^3$ or less for propane.

10. The air-conditioning apparatus of claim 1, wherein the refrigerant circuit encloses 20 kg or greater in the case where the refrigerant is R32, 19.43 kg or greater in the case where the refrigerant is the refrigerant mixture with the composition ratio of 44% for R32 and 56% for HFO-1234yf, 19.75 kg or greater in the case where the refrigerant is the refrigerant mixture with the composition ratio of 73% for R32 and 27% for HFO-1234yf, 18.98 kg or greater in the case where the refrigerant is HFO-1234yf, and 2.63 kg or greater in the case where the refrigerant is propane.

11. The air-conditioning apparatus of claim 1, wherein a detector of the refrigerant concentration detecting device is made of materials including tin oxide.

12. The air-conditioning apparatus of claim 2 wherein the branching pipes form a relay unit that includes a gas liquid separator and opening and closing devices that supply the gas refrigerant to indoor units performing heating among the indoor units, and supply the liquid refrigerant to indoor units performing cooling among the indoor units, and provided that a refrigerant quantity inside the relay unit is M3 (kg), a value (W2+M2+M3)/V obtained by dividing the sum of the branch-pipe enclosed refrigerant quantity W2, the refrigerant quantity M2 inside the indoor units, and the refrigerant quantity M3 inside the relay unit by the volume V of the air-conditioned space is used instead of the value (W2+M2)/V.

13. The air-conditioning apparatus of claim 2, wherein the shutoff valves are further provided at a position in the vicinity of the indoor units, and the refrigerant quantity M2 inside the indoor units is set to 0 kg.

14. The air-conditioning apparatus of claim 12, wherein the shutoff valves are further provided at a position in the vicinity of the indoor units, and the refrigerant quantity M2 inside the indoor units is set to 0 kg.

15. The air-conditioning apparatus of claim 3, wherein a length of the main pipes between the shutoff valves on the side of the main pipes and the branching pipes is set such that a value W3/V obtained by dividing a refrigerant quantity W3 (kg) in the main pipes between the shutoff valves on the side of the main pipes and the branching pipes by the volume V (m$^3$) of the air-conditioned space is less than or equal to the predetermined refrigerant charged quantity limit value B (kg/m$^3$), and a length of the branch pipes between the shutoff valves on the side of the branch pipes and the branching pipes is set such that a value W4/V obtained by dividing a refrigerant quantity W4 (kg) in the branch pipes between the shutoff valves on the side of the branch pipes and the branching pipes by the volume V (m$^3$) of the air-conditioned space is less than or equal to the predetermined refrigerant charged quantity limit value B (kg/m$^3$).

16. An air-conditioning apparatus comprising:

an outdoor unit configured to include a compressor and a heat source side heat exchanger;

a plurality of indoor units configured to include load-side expansion valves and load-side heat exchangers and configured to air-condition an air-conditioned space;

branching pipes, connected to the outdoor unit by a plurality of main pipes and connected to each indoor unit by a plurality of branch pipes, configured to branch a refrigerant from a side of the main pipes and circulate the refrigerant to the branch pipes, and converge the refrigerant from a side of the branch pipes and circulate the refrigerant to the main pipes;

a refrigerant concentration detecting device installed in a non-air-conditioned space, which is a different space from the air-conditioned space, and which is in a relative position where the refrigerant potentially spread into the air-conditioned space if the refrigerant leaks;

shutoff valves configured to shut off either or both flows between the outdoor unit and the branching pipes on the side of the main pipes and flows between the indoor units and the branching pipes on the side of the branch pipes; and a controller configured, upon determining that the refrigerant has leaked on a basis of a detection by the refrigerant concentration detecting device, to control the shutoff valves to shut off the refrigerant flows; wherein the branching pipes are installed in the non-air-conditioned space, the branching pipes form a relay unit that includes a gas liquid separator and opening and closing devices, wherein the gas liquid separator and the opening and closing devices supply the gas refrigerant to indoor units performing heating among the indoor units and supply the liquid refrigerant to indoor units performing cooling among the indoor units, and provided that a refrigerant quantity inside the main pipes is a main-pipe enclosed refrigerant quantity W1 (kg), a refrigerant quantity inside the branch pipes is a branch-pipe enclosed refrigerant quantity W2 (kg), a refrigerant quantity inside the outdoor unit is M1 (kg), a refrigerant quantity inside the indoor units is M2 (kg), and a refrigerant quantity inside the relay unit is M3 (kg), one of either a value (W1+M1)/V obtained by dividing a sum of the main-pipe enclosed refrigerant quantity W1 and the refrigerant quantity M1 inside the outdoor unit by a volume V ($m^3$) of the air-conditioned space or a value (W2+M2+M3)/V obtained by dividing a sum of the branch-pipe enclosed refrigerant quantity W2, the refrigerant quantity M2 inside the indoor units, and the refrigerant quantity M3 inside the relay unit by the volume V of the air-conditioned space is equal to or greater than a predetermined refrigerant charged quantity limit value B ($kg/m^3$) determined on a basis of a flammability risk of the refrigerant, wherein the shutoff valves shut off pipes on a side equal to or greater than the predetermined refrigerant charged quantity limit value B ($kg/m^3$).

17. The air-conditioning apparatus of claim 16, wherein a length of the main pipes between the shutoff valves on the side of the main pipes and the branching pipes is set such that a value W3/V obtained by dividing a refrigerant quantity W3 (kg) in the main pipes between the shutoff valves on the side of the main pipes and the branching pipes by a volume V ($m^3$) of the air-conditioned space is less than or equal to the predetermined refrigerant charged quantity limit value B ($kg/m^3$), and a length of the branch pipes between the shutoff valves on the side of the branch pipes and the branching pipes is set such that a value (W4+M3)/V obtained by dividing a sum of a refrigerant quantity W4 (kg) in the branch pipes between the shutoff valves on the side of the branch pipes and the branching pipes and a refrigerant quantity M3 (kg) inside the relay unit by the volume V ($m^3$) of the air-conditioned space is less than or equal to the predetermined refrigerant charged quantity limit value B ($kg/m^3$).

18. The air-conditioning apparatus of claim 16, wherein a value (W3+W2+M2+M3)/V obtained by dividing the sum of a refrigerant quantity W3 (kg) in the main pipes between the shutoff valves on the side of the main pipes and the branching pipes, a branch pipe enclosed refrigerant quantity W2 (kg), the refrigerant quantity M2 (kg) inside the indoor units, and the refrigerant quantity M3 (kg) inside the relay unit by a volume V ($m^3$) of the air-conditioned space is less than or equal to the predetermined refrigerant charged quantity limit value B ($kg/m^3$).

19. The air-conditioning apparatus of claim 16, wherein a value (W4+W1+M1+M3)/V obtained by dividing a sum of a refrigerant quantity W4 (kg) in the branch pipes between the shutoff valves on the side of the branch pipes and the branching pipes, a main-pipe enclosed refrigerant quantity W1 (kg), a refrigerant quantity M1 (kg) inside the outdoor unit, and the refrigerant quantity M3 (kg) inside the relay unit by a volume V ($m^3$) of the air-conditioned space is less than or equal to the predetermined refrigerant charged quantity limit value B ($kg/m^3$).

20. The air-conditioning apparatus of claim 16, wherein the shutoff valves are further provided at a position in the vicinity of the indoor units, and the refrigerant quantity M2 inside the indoor units is set to 0 kg.

* * * * *